US005805130A

United States Patent [19]

Yamamoto et al.

[11] Patent Number: 5,805,130

[45] Date of Patent: Sep. 8, 1998

[54] LIQUID CRYSTAL DISPLAY DEVICE AND METHOD FOR DRIVING THE SAME

[75] Inventors: Kunihiko Yamamoto, Kashiba; Shinya Takahashi, Yamatokoriyama; Hiroyuki Furukawa, Ueno; Sadahiko Yasukawa, Nara-ken; Yasukuni Yamane, Nara-ken; Yutaka Ishii, Nara, all of Japan

[73] Assignee: Sharp Kabushiki Kaisha, Osaka, Japan

[21] Appl. No.: 425,469

[22] Filed: Apr. 20, 1995

[30] Foreign Application Priority Data

| | | | |
|---|---|---|---|
| Apr. 27, 1994 | [JP] | Japan | 6-090354 |
| Nov. 25, 1994 | [JP] | Japan | 6-291848 |

[51] Int. Cl.[6] ..... G09G 3/36

[52] U.S. Cl. ..... 345/100; 345/103

[58] Field of Search ..... 345/87, 100, 103, 345/89, 147, 94, 95, 98; 359/54, 55

[56] References Cited

U.S. PATENT DOCUMENTS

| | | | |
|---|---|---|---|
| 4,929,058 | 5/1990 | Numao | 345/89 |
| 5,376,944 | 12/1994 | Mogi et al. | 345/100 |
| 5,420,604 | 5/1995 | Scheffer et al. | 345/100 |
| 5,457,551 | 10/1995 | Cultar et al. | 345/87 |
| 5,459,495 | 10/1995 | Scheffer et al. | 345/89 |
| 5,485,173 | 1/1996 | Scheffer et al. | 345/87 |
| 5,489,919 | 2/1996 | Kuwata et al. | 345/103 |
| 5,521,727 | 5/1996 | Inaba et al. | 345/89 |

FOREIGN PATENT DOCUMENTS

| | | | |
|---|---|---|---|
| 0585466 | 3/1994 | European Pat. Off. | 345/87 |
| 0595495 | 5/1994 | European Pat. Off. | 345/87 |
| 5-46127 | 2/1993 | Japan . | |
| 5100642 | 4/1993 | Japan . | |
| 6-4049 | 1/1994 | Japan . | |
| 6027908 | 2/1994 | Japan | 345/100 |
| 6051717 | 2/1994 | Japan | 345/87 |
| 6067626 | 3/1994 | Japan | 345/87 |
| 2280980 | 2/1995 | United Kingdom | 345/100 |

OTHER PUBLICATIONS

"A New Addressing Technique for Fast Responding STN LCDS", by T.N. Ruckmongathan et al, Japan Display '92—Proceddings of the 12th Int'l Display Research Conference, pp. 65–68.

"Ultimate Limits for Matrix Addressing of RMS–Responding Liquid–Crystal Displays", by J. Nehring et al, IEEE Transactions on Electron Devices, vol. ED–26, No. 5, pp. 795–802, 1979.

"A Generalized Addressing Technique for RMS Responding Matrix LCDS", by T.N. Ruckmongathan, 1988 International Display Research Conference, pp. 80–85.

"Active Addressing Method for High–Contrast Video–Rate STN Displays", by T.J. Scheffer et al, SID 92 Digest—Society for Infromation Display Int'l Symposium Digest of Technical Papers vol. XXIII, May 17–22, pp. 228–231.

*Primary Examiner*—Chanh Nguyen

[57] ABSTRACT

In a liquid crystal display device having a simple matrix liquid crystal display panel including a plurality of scanning electrodes disposed in parallel with each other and a plurality of data electrodes disposed in parallel with each other so as to cross the scanning electrodes, the scanning electrodes are divided into a predetermined number of sub-groups, and each sub-group is successively driven by utilizing an orthogonal function. For a selection, a signal having an electric potential of ±Vr, which is a selection pulse string according to the orthogonal function, is applied to the respective scanning electrodes as a scanning electrode driving signal. For a non-selection, a signal having an electric potential of 0 is applied to the respective scanning electrodes as the scanning electrode driving signal. On the other hand, a data electrode driving signal having an electric potential proportional to a sum of products of a display pattern and the scanning electrode driving signal is applied to the respective data electrodes. A bias value "A", which is a proportional constant therefor, is set in a predetermined range. Thus, a uniform display with a high contrast enabling a fast response can be realized while suppressing a frame response phenomenon and display inconsistencies.

22 Claims, 35 Drawing Sheets

FIG. 1

PRIOR ART 1 frame period ($T_F$)

T

L

| | | | | | | | | | | | | | | | | |
|---|---|---|---|---|---|---|---|---|---|---|---|---|---|---|---|---|
| F1 | 1 | 1 | 1 | 1 | 0 | 0 | 0 | 0 | 0 | 0 | 0 | 0 | 0 | 0 | 0 | 0 |
| F2 | 1 | −1 | 1 | −1 | 0 | 0 | 0 | 0 | 0 | 0 | 0 | 0 | 0 | 0 | 0 | 0 |
| F3 | 1 | 1 | −1 | −1 | 0 | 0 | 0 | 0 | 0 | 0 | 0 | 0 | 0 | 0 | 0 | 0 |
| F4 | 1 | −1 | −1 | 1 | 0 | 0 | 0 | 0 | 0 | 0 | 0 | 0 | 0 | 0 | 0 | 0 |
| F5 | 0 | 0 | 0 | 0 | 1 | 1 | 1 | 1 | 0 | 0 | 0 | 0 | 0 | 0 | 0 | 0 |
| F6 | 0 | 0 | 0 | 0 | 1 | −1 | 1 | −1 | 0 | 0 | 0 | 0 | 0 | 0 | 0 | 0 |
| F7 | 0 | 0 | 0 | 0 | 1 | 1 | −1 | −1 | 0 | 0 | 0 | 0 | 0 | 0 | 0 | 0 |
| F8 | 0 | 0 | 0 | 0 | 1 | −1 | −1 | 1 | 0 | 0 | 0 | 0 | 0 | 0 | 0 | 0 |
| F9 | 0 | 0 | 0 | 0 | 0 | 0 | 0 | 0 | 1 | 1 | 1 | 1 | 0 | 0 | 0 | 0 |
| F10 | 0 | 0 | 0 | 0 | 0 | 0 | 0 | 0 | 1 | −1 | 1 | −1 | 0 | 0 | 0 | 0 |
| F11 | 0 | 0 | 0 | 0 | 0 | 0 | 0 | 0 | 1 | 1 | −1 | −1 | 0 | 0 | 0 | 0 |
| F12 | 0 | 0 | 0 | 0 | 0 | 0 | 0 | 0 | 1 | −1 | −1 | 1 | 0 | 0 | 0 | 0 |
| F13 | 0 | 0 | 0 | 0 | 0 | 0 | 0 | 0 | 0 | 0 | 0 | 0 | 1 | 1 | 1 | 1 |
| F14 | 0 | 0 | 0 | 0 | 0 | 0 | 0 | 0 | 0 | 0 | 0 | 0 | 1 | −1 | 1 | −1 |
| F15 | 0 | 0 | 0 | 0 | 0 | 0 | 0 | 0 | 0 | 0 | 0 | 0 | 1 | 1 | −1 | −1 |
| F16 | 0 | 0 | 0 | 0 | 0 | 0 | 0 | 0 | 0 | 0 | 0 | 0 | 1 | −1 | −1 | 1 |

FIG. 4

PRIOR ART 1 frame period ($T_F$)

| | | | | | | | | | | | | | | | | |
|---|---|---|---|---|---|---|---|---|---|---|---|---|---|---|---|---|
| F1 | 1 | 1 | 1 | 1 | 1 | 1 | 1 | 1 | 1 | 1 | 1 | 1 | 1 | 1 | 1 | 1 |
| F2 | 1 | −1 | 1 | −1 | 1 | −1 | 1 | −1 | 1 | −1 | 1 | −1 | 1 | −1 | 1 | −1 |
| F3 | 1 | 1 | −1 | −1 | 1 | 1 | −1 | −1 | 1 | 1 | −1 | −1 | 1 | 1 | −1 | −1 |
| F4 | 1 | −1 | −1 | 1 | 1 | −1 | −1 | 1 | 1 | −1 | −1 | 1 | 1 | −1 | −1 | 1 |
| F5 | 1 | 1 | 1 | 1 | −1 | −1 | −1 | −1 | 1 | 1 | 1 | 1 | −1 | −1 | −1 | −1 |
| F6 | 1 | −1 | 1 | −1 | −1 | 1 | −1 | 1 | 1 | −1 | 1 | −1 | −1 | 1 | −1 | 1 |
| F7 | 1 | 1 | −1 | −1 | −1 | −1 | 1 | 1 | 1 | 1 | −1 | −1 | −1 | −1 | 1 | 1 |
| F8 | 1 | −1 | −1 | 1 | −1 | 1 | 1 | −1 | 1 | −1 | −1 | 1 | −1 | 1 | 1 | −1 |
| F9 | 1 | 1 | 1 | 1 | 1 | 1 | 1 | 1 | −1 | −1 | −1 | −1 | −1 | −1 | −1 | −1 |
| F10 | 1 | −1 | 1 | −1 | 1 | −1 | 1 | −1 | −1 | 1 | −1 | 1 | −1 | 1 | −1 | 1 |
| F11 | 1 | 1 | −1 | −1 | 1 | 1 | −1 | −1 | −1 | −1 | 1 | 1 | −1 | −1 | 1 | 1 |
| F12 | 1 | −1 | −1 | 1 | 1 | −1 | −1 | 1 | −1 | 1 | 1 | −1 | −1 | 1 | 1 | −1 |
| F13 | 1 | 1 | 1 | 1 | −1 | −1 | −1 | −1 | −1 | −1 | −1 | −1 | 1 | 1 | 1 | 1 |
| F14 | 1 | −1 | 1 | −1 | −1 | 1 | −1 | 1 | −1 | 1 | −1 | 1 | 1 | −1 | 1 | −1 |
| F15 | 1 | 1 | −1 | −1 | −1 | −1 | 1 | 1 | −1 | −1 | 1 | 1 | 1 | 1 | −1 | −1 |
| F16 | 1 | −1 | −1 | 1 | −1 | 1 | 1 | −1 | −1 | 1 | 1 | −1 | 1 | −1 | −1 | 1 |

FIG. 5

PRIOR ART 1 frame period ($T_F$)

| | | | | | | | | | | | | | | | | |
|---|---|---|---|---|---|---|---|---|---|---|---|---|---|---|---|---|
| F1 | 1 | 0 | 0 | 0 | 1 | 0 | 0 | 0 | 1 | 0 | 0 | 0 | 1 | 0 | 0 | 0 |
| F2 | 1 | 0 | 0 | 0 | -1 | 0 | 0 | 0 | 1 | 0 | 0 | 0 | -1 | 0 | 0 | 0 |
| F3 | 1 | 0 | 0 | 0 | 1 | 0 | 0 | 0 | -1 | 0 | 0 | 0 | -1 | 0 | 0 | 0 |
| F4 | 1 | 0 | 0 | 0 | -1 | 0 | 0 | 0 | -1 | 0 | 0 | 0 | 1 | 0 | 0 | 0 |
| F5 | 0 | 1 | 0 | 0 | 0 | 1 | 0 | 0 | 0 | 1 | 0 | 0 | 0 | 1 | 0 | 0 |
| F6 | 0 | 1 | 0 | 0 | 0 | -1 | 0 | 0 | 0 | 1 | 0 | 0 | 0 | -1 | 0 | 0 |
| F7 | 0 | 1 | 0 | 0 | 0 | 1 | 0 | 0 | 0 | -1 | 0 | 0 | 0 | -1 | 0 | 0 |
| F8 | 0 | 1 | 0 | 0 | 0 | -1 | 0 | 0 | 0 | -1 | 0 | 0 | 0 | 1 | 0 | 0 |
| F9 | 0 | 0 | 1 | 0 | 0 | 0 | 1 | 0 | 0 | 0 | 1 | 0 | 0 | 0 | 1 | 0 |
| F10 | 0 | 0 | 1 | 0 | 0 | 0 | -1 | 0 | 0 | 0 | 1 | 0 | 0 | 0 | -1 | 0 |
| F11 | 0 | 0 | 1 | 0 | 0 | 0 | 1 | 0 | 0 | 0 | -1 | 0 | 0 | 0 | -1 | 0 |
| F12 | 0 | 0 | 1 | 0 | 0 | 0 | -1 | 0 | 0 | 0 | -1 | 0 | 0 | 0 | 1 | 0 |
| F13 | 0 | 0 | 0 | 1 | 0 | 0 | 0 | 1 | 0 | 0 | 0 | 1 | 0 | 0 | 0 | 1 |
| F14 | 0 | 0 | 0 | 1 | 0 | 0 | 0 | -1 | 0 | 0 | 0 | 1 | 0 | 0 | 0 | -1 |
| F15 | 0 | 0 | 0 | 1 | 0 | 0 | 0 | 1 | 0 | 0 | 0 | -1 | 0 | 0 | 0 | -1 |
| F16 | 0 | 0 | 0 | 1 | 0 | 0 | 0 | -1 | 0 | 0 | 0 | -1 | 0 | 0 | 0 | 1 |

FIG. 13

Time →

1 frame period (TF)

T

L

| | | | | | | | | | | | | | | | | |
|---|---|---|---|---|---|---|---|---|---|---|---|---|---|---|---|---|
| F1 | 1 | 0 | 1 | 0 | 0 | 0 | 0 | 0 | 0 | 0 | 0 | 0 | 0 | 0 | 0 | 0 |
| F2 | 1 | 0 | −1 | 0 | 0 | 0 | 0 | 0 | 0 | 0 | 0 | 0 | 0 | 0 | 0 | 0 |
| F3 | 0 | 1 | 0 | 1 | 0 | 0 | 0 | 0 | 0 | 0 | 0 | 0 | 0 | 0 | 0 | 0 |
| F4 | 0 | 1 | 0 | −1 | 0 | 0 | 0 | 0 | 0 | 0 | 0 | 0 | 0 | 0 | 0 | 0 |
| F5 | 0 | 0 | 0 | 0 | 1 | 0 | 1 | 0 | 0 | 0 | 0 | 0 | 0 | 0 | 0 | 0 |
| F6 | 0 | 0 | 0 | 0 | 1 | 0 | −1 | 0 | 0 | 0 | 0 | 0 | 0 | 0 | 0 | 0 |
| F7 | 0 | 0 | 0 | 0 | 0 | 1 | 0 | 1 | 0 | 0 | 0 | 0 | 0 | 0 | 0 | 0 |
| F8 | 0 | 0 | 0 | 0 | 0 | 1 | 0 | −1 | 0 | 0 | 0 | 0 | 0 | 0 | 0 | 0 |
| F9 | 0 | 0 | 0 | 0 | 0 | 0 | 0 | 0 | 1 | 0 | 1 | 0 | 0 | 0 | 0 | 0 |
| F10 | 0 | 0 | 0 | 0 | 0 | 0 | 0 | 0 | 1 | 0 | −1 | 0 | 0 | 0 | 0 | 0 |
| F11 | 0 | 0 | 0 | 0 | 0 | 0 | 0 | 0 | 0 | 1 | 0 | 1 | 0 | 0 | 0 | 0 |
| F12 | 0 | 0 | 0 | 0 | 0 | 0 | 0 | 0 | 0 | 1 | 0 | −1 | 0 | 0 | 0 | 0 |
| F13 | 0 | 0 | 0 | 0 | 0 | 0 | 0 | 0 | 0 | 0 | 0 | 0 | 1 | 0 | 1 | 0 |
| F14 | 0 | 0 | 0 | 0 | 0 | 0 | 0 | 0 | 0 | 0 | 0 | 0 | 1 | 0 | −1 | 0 |
| F15 | 0 | 0 | 0 | 0 | 0 | 0 | 0 | 0 | 0 | 0 | 0 | 0 | 0 | 1 | 0 | 1 |
| F16 | 0 | 0 | 0 | 0 | 0 | 0 | 0 | 0 | 0 | 0 | 0 | 0 | 0 | 1 | 0 | −1 |

*FIG. 16*

| | | | | | | | |
|---|---|---|---|---|---|---|---|
| 1 | 1 | 1 | 1 | 1 | 1 | 1 | 1 |
| 1 | −1 | 1 | −1 | 1 | −1 | 1 | −1 |
| 1 | 1 | −1 | −1 | 1 | 1 | −1 | −1 |
| 1 | −1 | −1 | 1 | 1 | −1 | −1 | 1 |
| 1 | 1 | 1 | 1 | −1 | −1 | −1 | −1 |
| 1 | −1 | 1 | −1 | −1 | 1 | −1 | 1 |
| 1 | 1 | −1 | −1 | −1 | −1 | 1 | 1 |
| 1 | −1 | −1 | 1 | −1 | 1 | 1 | −1 |

| Scaling level | Display data in 1H | | | |
|---|---|---|---|---|
| 1 | −1 | −1 | −1 | −1 |
| 2 | −1 | −1 | 1 | 1 |
| 3 | −1 | 1 | 1 | 1 |
| 4 | 1 | 1 | 1 | 1 |

*FIG. 31A*

1 frame period (TF)

T

L

| | | | | | | | | | | | | | | | | |
|---|---|---|---|---|---|---|---|---|---|---|---|---|---|---|---|---|
| F1 | 1 | 0 | 1 | 0 | 0 | 0 | 0 | 0 | 0 | 0 | 0 | 0 | 0 | 0 | 0 | 0 |
| F2 | 1 | 0 | −1 | 0 | 0 | 0 | 0 | 0 | 0 | 0 | 0 | 0 | 0 | 0 | 0 | 0 |
| F3 | 0 | 1 | 0 | 1 | 0 | 0 | 0 | 0 | 0 | 0 | 0 | 0 | 0 | 0 | 0 | 0 |
| F4 | 0 | 1 | 0 | −1 | 0 | 0 | 0 | 0 | 0 | 0 | 0 | 0 | 0 | 0 | 0 | 0 |
| F5 | 0 | 0 | 0 | 0 | 1 | 0 | 1 | 0 | 0 | 0 | 0 | 0 | 0 | 0 | 0 | 0 |
| F6 | 0 | 0 | 0 | 0 | 1 | 0 | −1 | 0 | 0 | 0 | 0 | 0 | 0 | 0 | 0 | 0 |
| F7 | 0 | 0 | 0 | 0 | 0 | 1 | 0 | 1 | 0 | 0 | 0 | 0 | 0 | 0 | 0 | 0 |
| F8 | 0 | 0 | 0 | 0 | 0 | 1 | 0 | −1 | 0 | 0 | 0 | 0 | 0 | 0 | 0 | 0 |
| F9 | 0 | 0 | 0 | 0 | 0 | 0 | 0 | 0 | 1 | 0 | 1 | 0 | 0 | 0 | 0 | 0 |
| F10 | 0 | 0 | 0 | 0 | 0 | 0 | 0 | 0 | 1 | 0 | −1 | 0 | 0 | 0 | 0 | 0 |
| F11 | 0 | 0 | 0 | 0 | 0 | 0 | 0 | 0 | 0 | 1 | 0 | 1 | 0 | 0 | 0 | 0 |
| F12 | 0 | 0 | 0 | 0 | 0 | 0 | 0 | 0 | 0 | 1 | 0 | −1 | 0 | 0 | 0 | 0 |
| F13 | 0 | 0 | 0 | 0 | 0 | 0 | 0 | 0 | 0 | 0 | 0 | 0 | 1 | 0 | 1 | 0 |
| F14 | 0 | 0 | 0 | 0 | 0 | 0 | 0 | 0 | 0 | 0 | 0 | 0 | 1 | 0 | −1 | 0 |
| F15 | 0 | 0 | 0 | 0 | 0 | 0 | 0 | 0 | 0 | 0 | 0 | 0 | 0 | 1 | 0 | 1 |
| F16 | 0 | 0 | 0 | 0 | 0 | 0 | 0 | 0 | 0 | 0 | 0 | 0 | 0 | 1 | 0 | −1 |

*FIG. 31B*

| Scaling level | Display data | | |
|---|---|---|---|
| | First frame | Second frame | Third frame |
| 1 | −1 | −1 | −1 |
| 2 | −1 | −1 | 1 |
| 3 | −1 | 1 | 1 |
| 4 | 1 | 1 | 1 |

LIQUID CRYSTAL DISPLAY DEVICE AND METHOD FOR DRIVING THE SAME

BACKGROUND OF THE INVENTION

1. Field of the Invention

The present invention relates to a liquid crystal display device (hereinafter, referred to as an LCD) used for audio visual (AV) equipment, office automation (OA) equipment, etc. and a method for driving the same. More specifically, the present invention relates to a fast-response simple matrix LCD having a display screen with a large capacity.

2. Description of the Related Art

In recent years, there has been an increasing demand for LCDs capable of displaying moving pictures while keeping a high contrast and a fast response. Liquid crystal display panels of the LCDs are mainly classified into a simple matrix type and an active matrix type. Compared with the active matrix type, the simple matrix type is more advantageous in terms of cost since LCDs of this type are readily produced because of their simplified panel structure.

As simple matrix liquid crystal display panels enabling a large-capacity display, super twisted nematic (STN) liquid crystal display panels are used, which include STN liquid crystal between a pair of substrates and polarizing plates respectively provided outside the substrates. The configuration of the STN liquid crystal display panels will be described in detail below.

In an STN liquid crystal display panel, a plurality of data electrodes (signal electrodes) are provided in parallel with each other on one of a pair of substrates with an alignment film formed thereon. On the other substrate, a plurality of scanning electrodes are provided in parallel with each other with an alignment film formed thereon. The scanning electrodes extend in a direction orthogonally crossing a direction in which the data electrodes extend. STN liquid crystal between the substrates generally has its molecules twisted at an angle of about 180° to 270° so as to realize a high contrast. Polarizing plates are respectively provided outside the substrates.

Furthermore, STN liquid crystal display panels incorporating a phase compensating plate made of liquid crystal or a polymer film have been commercialized. Such STN liquid crystal display panels have currently been in vogue among the simple matrix liquid crystal display panels.

On the other hand, in order to improve a response characteristic of liquid crystal display panels, studies for making a liquid crystal layer thinner and for decreasing the viscosity of a liquid crystal material have been conducted. As a result, liquid crystal display panels capable of displaying moving pictures such as video images at a response speed of 150 ms or less have been under development.

In general, the simple matrix liquid crystal display panels are driven by a linear sequential scanning driving method. According to this method, scanning electrodes are sequentially selected one by one, and a data signal is supplied to a certain data electrode in synchronization with the selection. In this case, a repetition cycle (i.e., frame cycle) for selecting all of the data electrodes is normally 20 ms or less.

In the linear sequential scanning driving method, a voltage averaging optimum bias method (hereinafter, referred to as an optimum bias method) is adopted in accordance with the following principle.

In the optimum bias method, a scanning voltage and a signal voltage are respectively set so that a voltage applied to a display pixel has a root-mean-square (rms) value identical with that of a voltage applied to a non-display pixel and so that the ratio (operation margin=M) between a display pixel voltage and a non-display pixel voltage becomes maximum.

The operation margin M becomes maximum when a scanning voltage Vr and a data voltage Vc satisfy the following relationship with respect to the number of scanning lines N.

$$Vr = \sqrt{N} \cdot Vc \tag{1}$$

When the equation (1) is satisfied, crest values Vp and Vp' of the voltages applied to a display pixel and a non-display pixel are respectively represented by the following equations:

$$Vp = (\sqrt{N} + 1) \cdot Vc \tag{2}$$

$$Vp' = (\sqrt{N} - 1) \cdot Vc \tag{3}$$

However, as is apparent from the equations (2) and (3), according to the above-mentioned optimum bias method, the crest values Vp and Vp' of the voltages applied to the pixels increase with the increase in the number of scanning lines N. In order to avoid adverse effects caused by this, the application of technology for reducing a threshold voltage of liquid crystal and the use of a driver integrated circuit (IC) capable of withstanding a high voltage are required.

T. N. Ruckmongathan et al. proposed an IHAT (Improved Hybrid Addressing Technique), i.e., a driving method for simultaneously selecting a plurality of scanning electrodes so as to decrease each crest value of voltages applied thereto (International Display Research Conference, pp. 80–85, 1988).

According to the IHAT, N scanning electrodes in total are divided into (N/L) sub-groups each consisting of L scanning electrodes. All of the scanning electrodes belonging to one sub-group are simultaneously selected. The scanning electrodes are applied with a voltage of ±Vr when selected, whereas they are applied with a voltage of 0 when not selected. More specifically, as shown in FIG. 1, one frame period $T_F$ is equally divided into a plurality of periods T each corresponding to a sub-group. On a period-by-period basis, L (for example, 4 in an example shown in FIG. 1) scanning electrodes are simultaneously selected from all of the scanning electrodes (for example, 16, i.e., F1 to F16 in FIG. 1). At this time, a scanning signal voltage and a data signal voltage are respectively applied to a scanning electrode and a data electrode in accordance with a pattern allowing an orthogonal property to be established (in other words, allowing the inner product of a row vector to be 0) in each smaller portion than one frame (i.e., in each sub-group) surrounded by a square in FIG. 1. Thus, a liquid crystal display panel is driven.

To be more specific, in the IHAT, a liquid crystal display panel is driven as per the following steps (1) through (8).

(1) Set a signal pattern forming a normalized orthogonal function system per L-bit to be simultaneously selected for driving.

(2) Compare a scanning signal (+Vr: logic 1, −Vr: logic 0) in a selected sub-group with display data (display: logic 1, non-display: logic 0) on a bit-by-bit basis by obtaining exclusive OR of both so as to determine if the scanning signal in the selected sub-group is matched with the display data.

(3) Obtain the number of bits in which scanning signals are not matched with the display data, i.e., the total number i of mismatchings.

(4) Apply a voltage Vi represented by the following equation (4) to data electrodes based on the resultant total number i of mismatchings.

$$Vi=(L-2i)/L\cdot Vo \quad (4)$$

where Vo is a maximum amplitude of the data voltage. In the case of the total number i of mismatchings is 0, Vo becomes equal to Vi.

(5) Conduct the steps (2) through (4) with respect to all of the data electrodes, independently.

(6) Drive the scanning electrodes and the data electrodes simultaneously for a predetermined period T.

(7) Set a signal pattern with respect to next L bits to be simultaneously selected and repeat the steps (2) through (6) with respect to the signal patterns of all of the L bits.

(8) Repeat the above steps on a sub-group basis and complete scanning of one frame.

According to the above-mentioned optimum bias method, when a scanning voltage Vr satisfies the following equation (5) derived from the equation (1), the operation margin M become maximum.

$$Vr=\sqrt{(N/L)}\cdot Vo \quad (5)$$

The operation margin M is obtained in the same way as in the linear sequential driving method.

FIG. 2 shows an example of a circuit configuration using the IHAT.

A liquid crystal display panel 1 has N scanning electrodes 9 and M data electrodes 10. The scanning electrodes 9 are respectively connected to a scanning electrode driving circuit (scanning electrode driver) 2, and the data electrodes 10 are respectively connected to a data driving circuit (data electrode driver) 3. The scanning electrode driver 2 outputs a signal potential of ±Vr for a selection and a signal potential of 0 volt for a non-selection to the respective scanning electrodes 9 based on function data from an orthogonal functions generator 4.

Display data supplied from outside is once stored in a buffer memory 5 having a capacity corresponding to L scanning electrodes 9 to be simultaneously selected. Thereafter, output data of L bits corresponding to the selected L scanning electrodes 9 is compared with the function data of L bits from the orthogonal functions generator 4 by an exclusive OR circuit (EX-OR circuit) 6. The total number of bits in which the output data is not matched with the function data is calculated by an adder (SUM circuit) 7.

A calculated result is input to the data electrode driver 3 from the SUM circuit 7 through a digital/analog converter (D/A converter) 8. When data input to the data electrode driver 3 becomes one data electrode's worth of data, a signal voltage of a data signal is output to each data electrode 10 in unison. Thus, one frame's worth of data processing and voltage application are conducted and an input display image pattern is reproduced on the liquid crystal display panel 1.

The light transmittance of twisted nematic liquid crystal depends upon an rms value of a driving voltage. Because of this, when fast-response LCDs using twisted nematic liquid crystal are driven by the above-mentioned linear sequential scanning driving method, the liquid crystal becomes non-responsive to an rms value to which liquid crystal is supposed to respond, and the light transmittance of the liquid crystal is changed in response to waveforms Vp and Vp' of voltages applied to a display pixel and a non-display pixel; a so-called frame response phenomenon occurs. This causes the light transmittance of the non-display pixels to increase and that of the display pixels to decrease. Therefore, a contrast of a displayed image decreases. This makes it impossible to obtain satisfactory display characteristics. A phenomenon similar to this occurs in the case of driving a fast-response liquid crystal display panel having not more than 150 ms of total times of a rising time and a falling time of the liquid crystal by the linear sequential scanning driving method.

FIG. 3 shows a contrast characteristic represented by a solid line L1 in the case where the IHAT, which allows the crest value of a voltage applied to liquid crystal to decrease by simultaneously driving scanning electrodes by a plurality of electrodes, is applied to a fast-response LCD. In this figure, a vertical axis represents a maximum possible contrast and a horizontal axis represents the number of scanning lines to be simultaneously selected. The case where one scanning line is selected corresponds to the linear sequential scanning driving method. In this evaluation, an STN LCD having a response speed of about 120 ms and a frame frequency of 60 Hz is driven by the optimum bias method with a duty ratio of 1/256.

For comparison, FIG. 3 shows a contrast characteristic represented by a broken line L2 in the case where the above-mentioned STN LCD is driven with a rectangular wave of 300 Hz which does not bring the frame response phenomenon.

When a half of all the scanning lines are simultaneously selected for driving by the conventional IHAT, a crest of a voltage can be decreased. However, as represented by the line L1 of FIG. 3, adverse effects of suppressing the frame response phenomenon are small under this driving condition. Furthermore, even if half of all the scanning lines are simultaneously selected for driving, the contrast represented by the line L1 is about 80% of that represented by the line L2. Thus, the conventional IHAT cannot allow an image having a display characteristic with a high contrast to be formed at a high speed.

In recent years, the following two techniques have been proposed as a driving method for suppressing adverse effects of the above-mentioned frame response phenomenon.

One of the techniques is an active addressing method (AAM). The AAM uses a WALSH function or the like as an orthogonal function. A positive or negative voltage (i.e., 1 or −1) derived from this function is applied to all of the scanning electrodes (F1 to F16) in unison, as shown in FIG. 4, thereby driving a liquid crystal display panel so as to establish an orthogonal property in one frame period $T_F$ (i.e., so as to render the inner product of a row vector 0). The AAM is disclosed, for example, by T. J. Scheffer et al., SID'92, Digest, p. 228, and Japanese Laid-Open Patent Publication No. 5-100642.

The other of the techniques is a sequence addressing technique (SAT). According to this technique, one frame is equally divided into a plurality of periods as shown in FIG. 5, a plurality of electrodes (for example, 4 in an example shown in FIG. 5) are simultaneously selected from all of the scanning electrodes (for example, 16, i.e., F1 to F16 in FIG. 5) on a period-by-period basis, and a liquid crystal display panel is driven so as to establish an orthogonal property in one frame period $T_F$. The SAT is disclosed, for example, by T. N. Ruckmongathan et al., Japan Display 92, Digest, p. 65; and Japanese Laid-Open Patent Publication Nos. 5-46127 and 6-4049.

The AAM, the SAT, and the IHAT are based on the identical principle in terms of driving a liquid crystal display panel by using an orthogonal function. The driving principle is disclosed, for example, by J. Nehring et al., "Ultimate Limit for Matrix Addressing of RMS-Responding Liquid-Crystal Displays", IEEE Trans. ED, Vol. ED26, p. 795, 1979. Hereinafter, the driving principle will be described.

In driving an rms-responsive-type XY matrix liquid crystal display panel, a data voltage waveform G(t) is given in proportion to the sum of products of display data Ii and a scanning voltage waveform Fi(t) when a scanning voltage waveform Fi(t) is given, as represented by the following equation (6):

$$G(t)=A\cdot\Sigma(Ii\cdot Fi(t)) \tag{6}$$

where Fi(T) is an orthogonal function column and takes an rms; A is a proportional constant. According to the above-mentioned optimum bias method, when the following equation (7) is satisfied:

$$A = 1/\sqrt{N} \tag{7}$$

the operation margin M becomes maximum.

According to the IHAT method, a buffer memory having a capacity corresponding to the number of electrodes to be simultaneously selected will suffice. In contrast to this, the AAM and the SAT allow the selection of electrodes to be repeated over one frame period, so that display data needs to be held over one frame period. Thus, the AAM and the SAT require a buffer memory having a large capacity for storing one screenful of data signal.

According to the AAM, all of the scanning lines are simultaneously selected, which increases the size of an arithmetic circuit. As a result, there arise problems such as the enlargement of a circuit configuration required and the increase in cost and power consumption.

The AAM and the SAT have effects of eliminating the frame response phenomenon. However, when the AAM and the SAT are applied to driving of the above-mentioned fast-response liquid crystal display panel, display information of a certain scanning electrode affects a display state of another scanning electrode, causing display inconsistencies. This is significant in terms of uniformity of an image quality and a gray-scale display.

As described above, unlike the AAM and the SAT requiring a large-capacity buffer memory, the IHAT allows the selection of electrodes to be repeated only in ½ or less of one frame; therefore, the IHAT has an advantage in its miniaturized buffer memory circuit. However, the IHAT requires arithmetic circuits equal in number to the number of scanning electrodes, to be simultaneously selected. This is likely to increase the whole size of arithmetic circuits, compared with the SAT. Furthermore, the IHAT requires expensive analog drivers for data electrodes in the same way as in the AAM; thus, there also arise problems in terms of cost and power consumption.

The inventors of the present invention conducted an experiment for evaluating display inconsistencies of an image caused by the conventional IHAT. The results of this experiment will be described with reference to FIGS. 6, 7A, 7B, 8A and 8B.

Specifically, two kinds of STN liquid crystal display panels, having a response speed τ of 100 ms and 140 ms, respectively, were driven by the IHAT so as to display 10 kinds of display patterns represented by A through J of FIG. 6. Display inconsistencies caused when each pattern was displayed, were evaluated.

Consequently, the following was found: Although a contrast is decreased as a whole due to the frame response phenomenon, the degree of variation in light transmittance depending upon display patterns are changed with the size of one block, i.e., the number L of scanning electrodes to be simultaneously selected. This will be described with reference to FIGS. 7A and 7B in which the response speed τ is 100 ms and FIGS. 8A and 8B in which the response speed τ is 140 ms. In any of these figures, vertical axes represent transmittance and horizontal axes represent a voltage, and "ON" and "OFF" correspond to states where the respective first rows of the display patterns A through J are displayed as "ON" or "OFF", respectively.

FIG. 7A shows transmittance characteristics in the case where a liquid crystal display panel is driven under the conditions of a response speed τ of 100 ms, the number of row scanning electrodes N of 200, the number L of simultaneously selected scanning electrodes of 100, and a frame frequency F of 60 Hz. As is understood from FIG. 7A, large variations of transmittance are observed depending upon display patterns.

FIG. 7B shows transmittance characteristics in the case where a liquid crystal display panel is driven under the same conditions as those of FIG. 7A, except that the number L of simultaneously selected scanning electrodes is 50. As is understood from FIG. 7B, the variations of transmittance depending upon display patterns are substantially reduced, compared with the case where L is set to be 100 (FIG. 7A).

FIG. 8A shows transmittance characteristics in the case where a liquid crystal display panel is driven under the conditions of a response speed τ of 140 ms which is slower than the value in FIGS. 7A and 7B, the number of row scanning electrodes N of 200, the number L of simultaneously selected scanning electrodes of 100, and a frame frequency F of 60 Hz. As is understood from FIG. 8A, variations of transmittance are smaller than the case of FIG. 7A using the liquid crystal display panel having a higher response speed τ.

FIG. 8B shows transmittance characteristics in the case where a liquid crystal display panel is driven under the same conditions as those of FIG. 8A, except that the number L of simultaneously selected scanning electrodes is 50. As is understood from FIG. 8B, the variations of transmittance depending upon display patterns are substantially reduced, compared with the case where L is set to be 100 (FIG. 8A). In addition, the variations of transmittance are smaller than the case of FIG. 7B using the liquid crystal display panel having a higher response speed τ.

As described above, by changing the number L of simultaneously selected scanning electrodes or changing a response speed of a liquid crystal display panel, the variations of transmittance depending upon display patterns can be eliminated. The reasons for this are considered as follows:

In general, an rms voltage value <Uij> of an i-row and j-column dot of display pixels in a liquid crystal display panel is given by the following equations (8) and (9):

$$<Uij> = \sqrt{1/T_F \cdot \int_0^{T_F} Uij^2(t)dt} \tag{8}$$

$$Uij^2(t)dt = \int_0^{T_F} Fi^2(t)dt - (2\cdot A)\cdot \left[\int_0^{T_F} I1j\cdot\{Fi(t)\cdot F1(t)\}dt + \ldots + \int_0^{T_F} Iij\cdot\{Fi(t)\cdot Fi(t)\}dt + \ldots\right. \tag{9}$$

-continued $$+\int_0^{T_F} INj \cdot \{Fi(t) \cdot FN(t)\}dt \Bigg] + (A^2) \cdot \Bigg[ \int_0^{T_F} \{I1j^2 \cdot F1^2(t) + \ldots$$

$$Iij^2 \cdot Fi^2(t) + \ldots + INj^2 \cdot FN^2(t)\}dt \Bigg] + (2 \cdot A^2) \Bigg[ \int_0^{T_F} \{I1j \cdot I2j \cdot$$

$$F1(t) \cdot F2(t) + \ldots + INj \cdot I1j \cdot FN(t) \cdot F1(t) + \ldots \}dt \Bigg]$$

where <Uij> is an rms voltage value of i-row and j-column; Iij is display data (ON is −1, and OFF is +1); and TF is one frame period.

In the case where an orthogonal property among the respective scanning electrodes is established in a predetermined period, that is, the inner product of a row vector is 0. the following portion in the equation (9) (hereinafter, referred to as a correlation term) becomes 0.

$$\int_0^{T_F} \{Fm(t) \cdot Fn(t)\}dt \tag{10}$$

$$(m \neq n\ m,\ n = 1 \sim N)$$

In this case, display inconsistencies are not caused by variations of an rms depending upon display pattern Iij.

For example, in the cases where L is 50 and 100 in the above-mentioned experiment, an orthogonal property among the respective scanning electrodes is established in ¼ and ½ of one frame, respectively. The correlation term becomes 0. As a result, variations of an rms are not caused depending upon display patterns.

However, in the case of fast-response liquid crystal display panels, a period required for cumulative response of a liquid crystal becomes substantially shorter than one frame period ($T_F$). Consequently, it is considered that large display inconsistencies occur depending upon display patterns in the case where L is equal to 100, requiring a longer period for establishing an orthogonal property among the respective scanning electrodes.

According to the AAM and the SAT, because of their driving principle, one frame period is required for establishing an orthogonal property among the respective scanning electrodes. For this reason, the AAM and the SAT cannot prevent the display inconsistencies from occurring depending upon response speeds and display patterns of a liquid crystal display panel as described with respect to the IHAT. According to the IHAT, display inconsistencies occur to a degree smaller than that of the AAM and the SAT; however, such inconsistencies need to be further eliminated so as to be applied to fast-response liquid crystal display panels.

SUMMARY OF THE INVENTION

The liquid crystal display device of the present invention, includes:

a simple matrix liquid crystal display panel having N scanning electrodes disposed in parallel with each other and M data electrodes disposed in parallel with each other so as to cross the scanning electrodes, pixels being respectively provided at crossed points of the scanning electrodes and the data electrodes;

a memory for storing image data corresponding to each of N/L scanning electrode groups, including L scanning electrodes, L being smaller than N;

an orthogonal function generating means for generating orthogonal function data per the scanning electrode group;

a first operation means for multiplying image data corresponding to each of the scanning electrode groups output from the memory by the orthogonal function data output from the orthogonal function generating means and outputting resultant product data;

a second operation means for successively receiving and adding up the product data and outputting resultant sum data;

a third operation means for multiplying the sum data by a predetermined proportional constant A so as to generate a driving control signal and outputting the signal;

a data electrode driving means for outputting a data electrode driving signal based on the driving control signal; and a scanning electrode driving means for receiving the orthogonal function data from the orthogonal function generating means and scanning the scanning electrode groups in synchronization with the output of the data electrode driving signal, wherein the predetermined proportional constant A is set in a range of $(1/\sqrt{N}) < A \leqq (1/\sqrt{N}) \cdot 4$.

In one embodiment of the invention, the number L of the scanning electrodes in each of the scanning electrode groups is selected so as to be close to N/2.

In another embodiment of the invention, the scanning electrode driving means outputs an electric potential of ±Vr volts to selected scanning electrodes and an electric potential of 0 volt to non-selected scanning electrodes.

In another embodiment of the invention, the first operation means is an exclusive OR circuit, and the second operation means is a sum circuit.

According to another aspect of the invention, a method for driving a liquid crystal display device including a simple matrix liquid crystal display panel having N scanning electrodes disposed in parallel with each other and M data electrodes disposed in parallel with each other so as to cross the scanning electrodes, includes the steps of:

dividing the scanning electrodes into N/L groups by a predetermined number L and successively driving each group utilizing an orthogonal function;

applying an electric potential of ±Vr volts to selected scanning electrodes and an electric potential of 0 volt to non-selected scanning electrodes, respectively as a scanning electrode driving signal;

applying an electric potential obtained by multiplying a sum of products of an image display pattern and the scanning electrode driving signal by a predetermined proportional constant A to the data electrode as a data electrode driving signal, wherein the proportional constant A is set in a range of $(1/\sqrt{N}) < A \leqq (1/\sqrt{N}) \cdot 4$.

In one embodiment of the invention, the predetermined number L is selected so as to be close to N/2.

In another embodiment of the invention, an exclusive OR operation and a sum operation are performed for obtaining the sum of products.

Alternatively, a method for driving a liquid crystal display device including a simple matrix liquid crystal display panel having N scanning electrodes disposed in parallel with each other and M data electrodes disposed in parallel with each other so as to cross the scanning electrodes, the N scanning electrodes being grouped into N/L scanning electrode groups each including L scanning electrodes, L being smaller than N, the method includes the steps of:

(a) storing image data corresponding to selected one of the N/L scanning electrode groups in a memory;

(b) generating orthogonal function data of L bits;

(c) reading the image data from the memory;

(d) multiplying the orthogonal function data by the image data on a pixel by pixel basis to obtain product data and summing the product data with respect to all of the pixels to give sum data;

(e) multiplying the sum data by a predetermined proportional constant A to generate a driving control signal;

(f) outputting a data electrode driving signal to either one of the data electrodes based on the driving control signal;

(g) repeating the steps (b) through (f) with respect to each of the L data electrodes included in the selected scanning electrode group;

(h) simultaneously driving the L scanning electrodes included in the selected scanning electrode group and a data electrode group composed of the data electrodes associated with the selected scanning electrode group;

(i) generating another orthogonal function data of L bits and repeating the steps (b) through (h) with respect to all of the orthogonal function data of L bits; and (j) repeating the steps (a) through (i) per remaining scanning electrode groups so as to scan an entire surface of the liquid crystal display panel, wherein the proportional constant A is set in a range of $(1/\sqrt{N})<A\leqq(1/\sqrt{N})\cdot 4$.

In one embodiment of the invention, the number L of the scanning electrodes in each of the scanning electrode group is selected so as to be close to N/2.

In another embodiment of the invention, the scanning electrode driving means outputs an electric potential of ±Vr volts to selected scanning electrodes and an electric potential of 0 volt to non-selected scanning electrodes.

In another embodiment of the invention, an exclusive OR operation is performed for obtaining the product data and an adding operation is performed for obtaining the sum data.

Alternatively, a method for driving a liquid crystal display device including a simple matrix liquid crystal display panel having a plurality of scanning electrodes and a plurality of data electrodes disposed so as to cross the scanning electrodes, pixels being respectively provided at crossed points of the scanning electrodes and the data electrodes, the method includes the steps of:

(a) dividing the plurality of scanning electrodes into a plurality of blocks composed of a first number of scanning electrodes, the first number being smaller than a total number of the scanning electrodes, and further dividing each of the plurality of blocks into a plurality of groups composed of a second number of plurality of scanning electrodes, the second number being smaller than the first number;

(b) simultaneously applying, as a scanning electrode driving signal, a selection pulse string according to an orthogonal function per predetermined period in a division period obtained by dividing one frame period corresponding to a period for displaying one display screen, and a voltage at a predetermined level in the other periods, to the scanning electrodes included in a selected one of the plurality of groups; and (c) applying a data electrode driving signal corresponding to a sum of products of the orthogonal function and display data to each of the data electrodes associated with the selected block, wherein the steps (b) and (c) are performed with respect to all of the plurality of blocks in the one frame period with a timing shifted.

In one embodiment of the invention, the number of the scanning electrodes is N, the number of the data electrodes is M, a scanning electrode driving signal applied to an i-th row ($1\leqq i\leqq N$) of the scanning electrodes is given by a predetermined function Fi(t), and a data electrode driving signal applied to a j-th column ($1\leqq j\leqq M$) of the data electrodes is given by $$Gj(t) = A \cdot \sum_{i=1}^{N} (Fi(t) \cdot Iij) \tag{14}$$

where a proportional constant A is $1/\sqrt{N}<A\leqq(1/\sqrt{N})\cdot 4$.

In another embodiment of the invention, the above-mentioned method further includes the step of performing frame modulation for varying a ratio between ON data and OFF data in the data electrode driving signal in accordance with the display data over a plurality of frames, thereby performing a gray scale display.

In another embodiment of the invention, the above-mentioned method further includes the step of performing pulse modulation for varying a pulse width of the data electrode driving signal in accordance with the display data, thereby performing a gray scale display.

In another embodiment of the invention, the above-mentioned method further includes the step of performing a combination of frame modulation for varying a ratio between ON data and OFF data in the data electrode driving signal in accordance with the display data over a plurality of frames and pulse modulation for varying a pulse width of the data electrode driving signal in accordance with the display data, thereby performing a gray scale display.

In another embodiment of the invention, the above-mentioned method further includes the step of monotonously increasing at least one of the scanning electrode driving signal and the data electrode driving signal, followed by monotonously decreasing it, or monotonously decreasing at least one of the scanning electrode driving signal and the data electrode driving signal, followed by monotonously decreasing it, every time an application period of a selection pulse starts, thereby forming a voltage waveform with a predetermined rms.

In another embodiment of the invention, the above-mentioned method further includes the steps of detecting a distorted electric potential generated on a detection electrode provided in parallel with the scanning electrodes and applying a voltage component compensating the distorted electric potential to the scanning electrode driving signal.

Alternatively, a liquid crystal display device includes:

a simple matrix liquid crystal display panel having a plurality of scanning electrodes and a plurality of data electrodes disposed so as to cross the scanning electrodes, pixels being respectively provided at crossed points of the scanning electrodes and the data electrodes; and a driving means for dividing the plurality of scanning electrodes into a plurality of blocks composed of a first number of scanning electrodes, the first number being smaller than a total number of the scanning electrodes, and further dividing each of the plurality of blocks into a plurality of groups composed of a second number of plurality of scanning electrodes, the second number being smaller than the first number, the driving means further performing a first operation for simultaneously applying, as a scanning electrode driving signal, a selection pulse string according to an orthogonal function per predetermined period in a division period obtained by dividing one frame period corresponding to a period for displaying one display screen, and a voltage at a predetermined level in the other periods, to the scanning electrodes included in one selected group of the plurality of groups, and a second operation for applying a data electrode driving signal corresponding to a sum of products of the orthogonal function and display data to each of the data electrodes associated with the selected block, wherein the first and second operations are performed with respect to all of the plurality of blocks in the one frame period with a timing shifted.

Thus, the invention described herein makes possible the advantages of (1) providing a miniaturized and simplified fast-response liquid crystal display device capable of displaying an image with a high contrast and a uniform high quality while eliminating a frame response phenomenon and display inconsistencies; and (2) providing a method for driving the same.

These and other advantages of the present invention will become apparent to those skilled in the art upon reading and understanding the following detailed description with reference to the accompanying figures.

BRIEF DESCRIPTION OF THE DRAWINGS

FIG. 1 is an diagram showing an example of an orthogonal function used in a IHAT.

FIG. 4 is a diagram showing an example of an orthogonal function used in an AAM.

FIG. 5 is a diagram showing an example of an orthogonal function used in an SAT.

FIG. 13 is a diagram showing an exemplary orthogonal function used in Example 2 according to the present invention.

FIG. 16 is a diagram showing an exemplary 8-order WALSH function used for generating a selection pulse string to be applied during each division period T of the driving pattern shown in FIG. 15.

FIGS. 31A and 31B show a function used for orthogonally transforming a data pattern used in a case where a 4-level gray scale display is performed in Example 7 according to the present invention.

DESCRIPTION OF THE PREFERRED EMBODIMENTS

Hereinafter, the present invention will be described by way of illustrative examples with reference to the drawings.

Example 1

Figure 9:
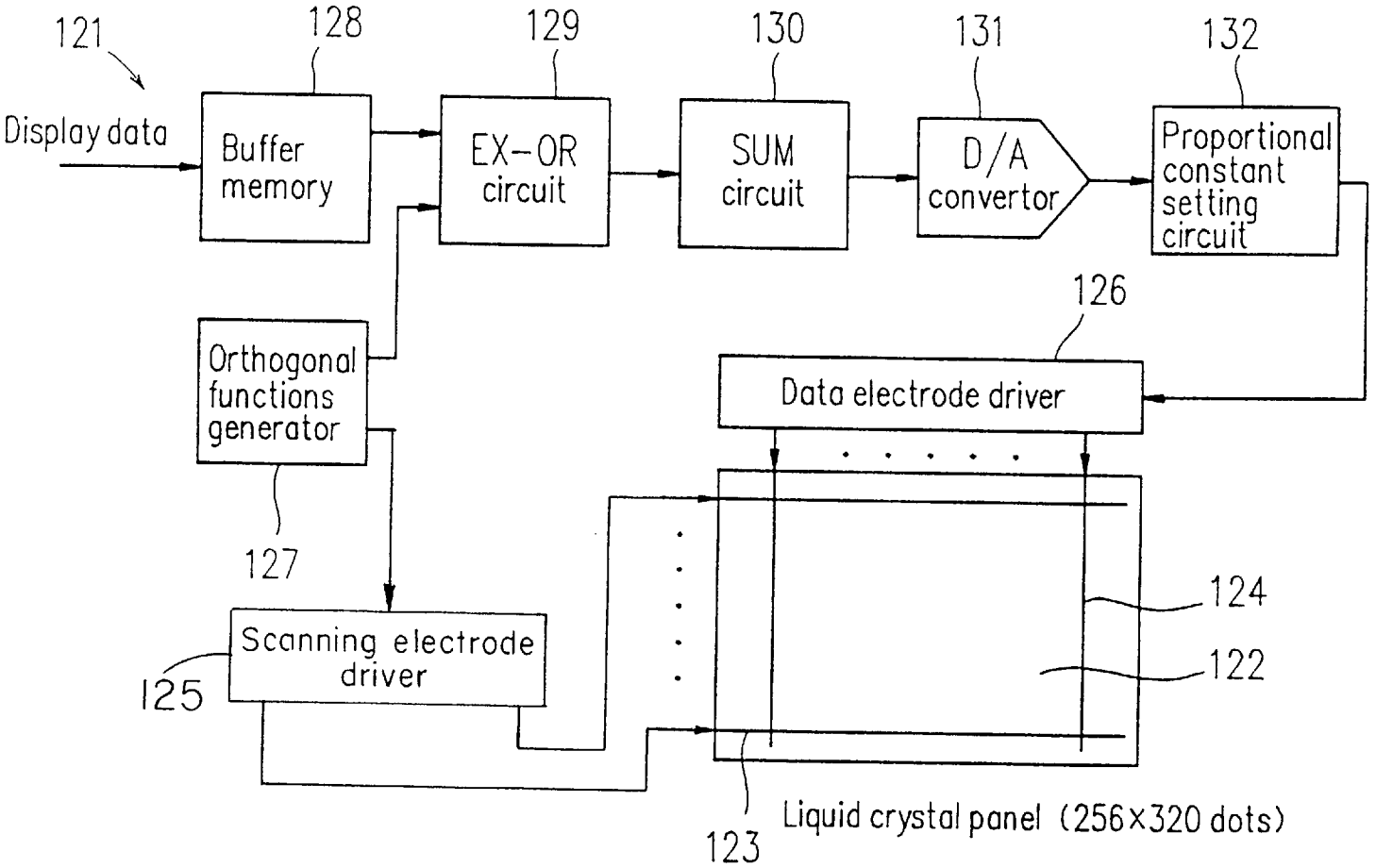
FIG. 9 is a block diagram showing an exemplary configuration of a driving circuit of Example 1 according to the present invention.

FIG. 9 is a block diagram showing an electrical configuration of an LCD 121 of Example 1 according to the present invention. The LCD 121 has a liquid crystal display panel 122 provided with N (e.g., 256) scanning electrodes 123 and M (e.g., 320) data electrodes 124. The scanning electrodes 123 are respectively connected to a scanning electrode driving circuit (scanning electrode driver) 125 and the data electrodes 124 are respectively connected to a data electrode driving circuit (data electrode driver) 126. The scanning electrode driver 125 outputs a signal potential of ±Vr for a selection and a signal potential of 0 volt for a non-selection to the respective scanning electrodes 123 based on function data from an orthogonal functions generator 127.

Display data supplied from the outside is once stored in a buffer memory 128 having a capacity corresponding to L scanning electrodes 123 to be simultaneously selected. Thereafter, output data of L bits corresponding to the selected L scanning electrodes 123 is compared with the function data of L bits from the orthogonal functions generator 127 by an exclusive OR circuit (EX-OR circuit) 129. The total number of bits in which the output data is not matched with the function data (number of mismatchings) is calculated by an adder (SUM circuit) 130.

The calculated result is sequentially input from the SUM circuit 130 to a digital/analog converter (D/A converter) 131 so as to be converted into analog data. The analog data is multiplied by a factor of a constant by a proportional constant setting circuit 132, and the constant-multiplied analog data is input to the data electrode driver 126. When data input to the data electrode driver 126 becomes one data electrode's worth of data, a signal voltage of a data signal is output to each data electrode 124 in unison. Thus, one frame's worth of data processing and voltage application are conducted and an input display image pattern is reproduced on the liquid crystal display panel 122.

In the LCD 121 of the present example, the proportional constant setting circuit 132 is used for providing an image with a higher contrast, as described above. The proportional constant setting circuit 132 may incorporate an amplifying circuit such as an operation amplifier so as to arbitrarily set an amplification rate.

Figure 10:
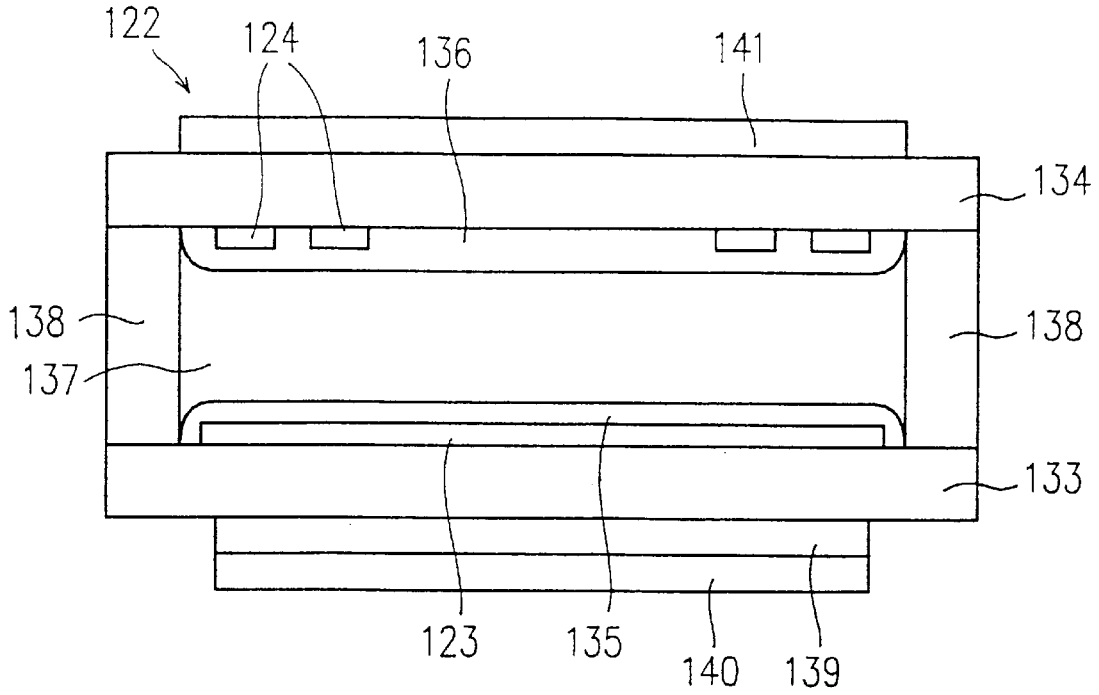
FIG. 10 is a cross-sectional view of a liquid crystal display panel adopting a driving method of Example 1 according to the present invention.

FIG. 10 is a cross-sectional view of a liquid crystal display panel 122. The liquid crystal display panel 122 includes 256 scanning electrodes 123 and 320 data electrodes 124 on a pair of glass substrates 133 and 134, respectively. The glass substrates 133 and 134 are covered with alignment films 135 and 136, respectively. Furthermore, STN liquid crystal 137 is injected between the alignment films 135 and 136 so as to be sealed therein with a sealant 138.

The glass substrate 133 has a phase compensation plate 139 and a polarizing plate 140 on its outer surface. The glass substrate 134 has a polarizing plate 141 on its outer surface. The phase compensation plate 139 is made of a polymer film, for example.

The liquid crystal display panel 122 of the present example is a compensation type STN-LCD having the above-mentioned construction. The orientation of liquid crystal molecules in the liquid crystal display panel 122 is typically twisted at 240°. The liquid crystal layer 137 typically has a thickness of about 4 $\mu$m and a response speed of about 120 ms.

Figure 11:
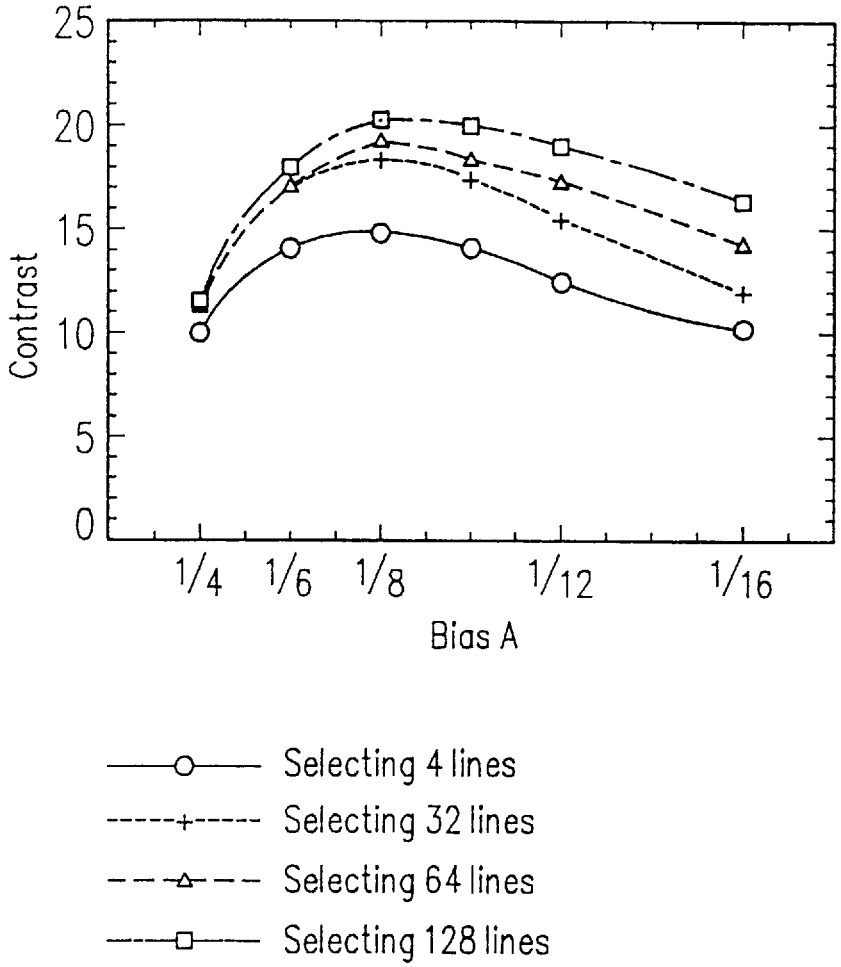
FIG. 11 is a graph showing the relationship between a bias value A and a contrast in a case of changing the number of simultaneously selected lines in the fast-response liquid crystal display panel of Example 1 according to the present invention.

A data voltage waveform G(t) of the present example is an electric potential proportional to the sum of products of a display pattern Ii and a scanning voltage waveform Fi(t); A proportional constant A is referred to as a bias value. FIG. 11 is a graph showing the relationship between a bias value A and a contrast in a case where the number of simultaneously selected lines is 4, 32, 64, and 128 under the condition that the total number N of the scanning electrodes 123 is 256.

According to the conventional optimum bias method, the maximum contrast is obtained at A=1/16. In contrast to this, according to the driving method of the present example, as is apparent from FIG. 11, the maximum contrast is obtained at a bias value A greater than 1/16 irrespective of the number of simultaneously selected data electrodes 123. In the present example, the maximum contrast is obtained approximately at A=1/8 in any number of selected data electrodes 123. In particular, a higher contrast is obtained when the bias value A is more than 1/16 and less than 1/4.

As is apparent from FIG. 11, preferably, a display with a higher contrast can be obtained by setting the bias value A substantially in the range of 1/6 to 1/12. In other words, since the number N of the scanning electrodes in the present example is 256, satisfactory display performance with a substantially high contrast can be obtained by setting the bias value A in the range represented by the following equation (11):

$$(1/\sqrt{256})\cdot 1.3 < A < (1/\sqrt{256})\cdot 2.7 \tag{11}$$

where constants 1.3 and 2.7 included in the equation (11) are respectively determined by equations: $(1/12)/(1/\sqrt{256})\approx 1.3$ and $(1/6)/(1/\sqrt{256})\approx 2.7$ so that the lower limit of the bias value A and the upper limit thereof are 1/12 and 1/6, respectively.

Figure 12:
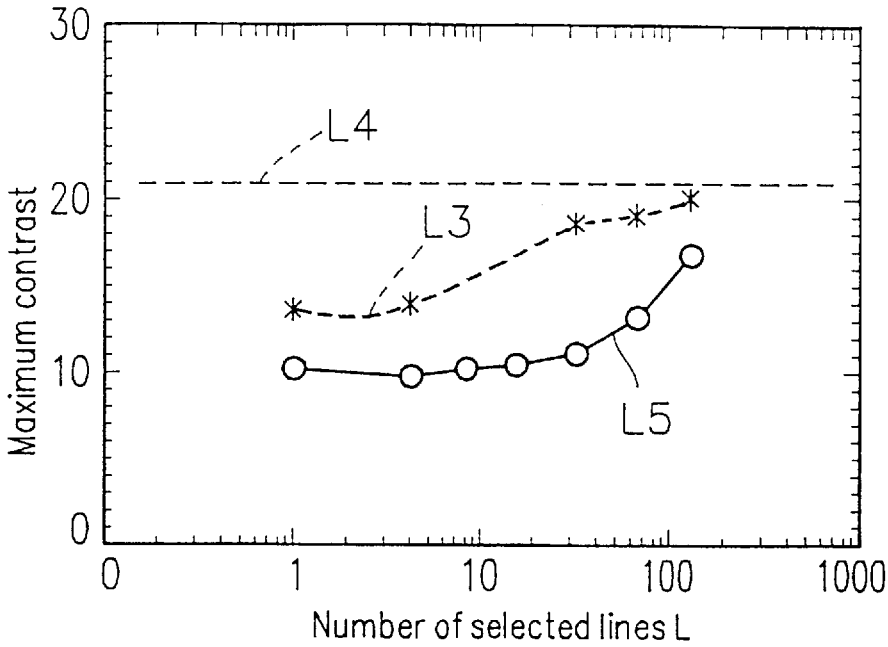
FIG. 12 is a graph showing the relationship between the number of selected lines L and the maximum contrast in the fast-response liquid crystal display panel of Example 1 according to the present invention.

FIG. 12 is a graph showing the relationship between the maximum contrast and the number of simultaneously selected lines L in a method for driving an LCD according to the present example.

Figure 2:
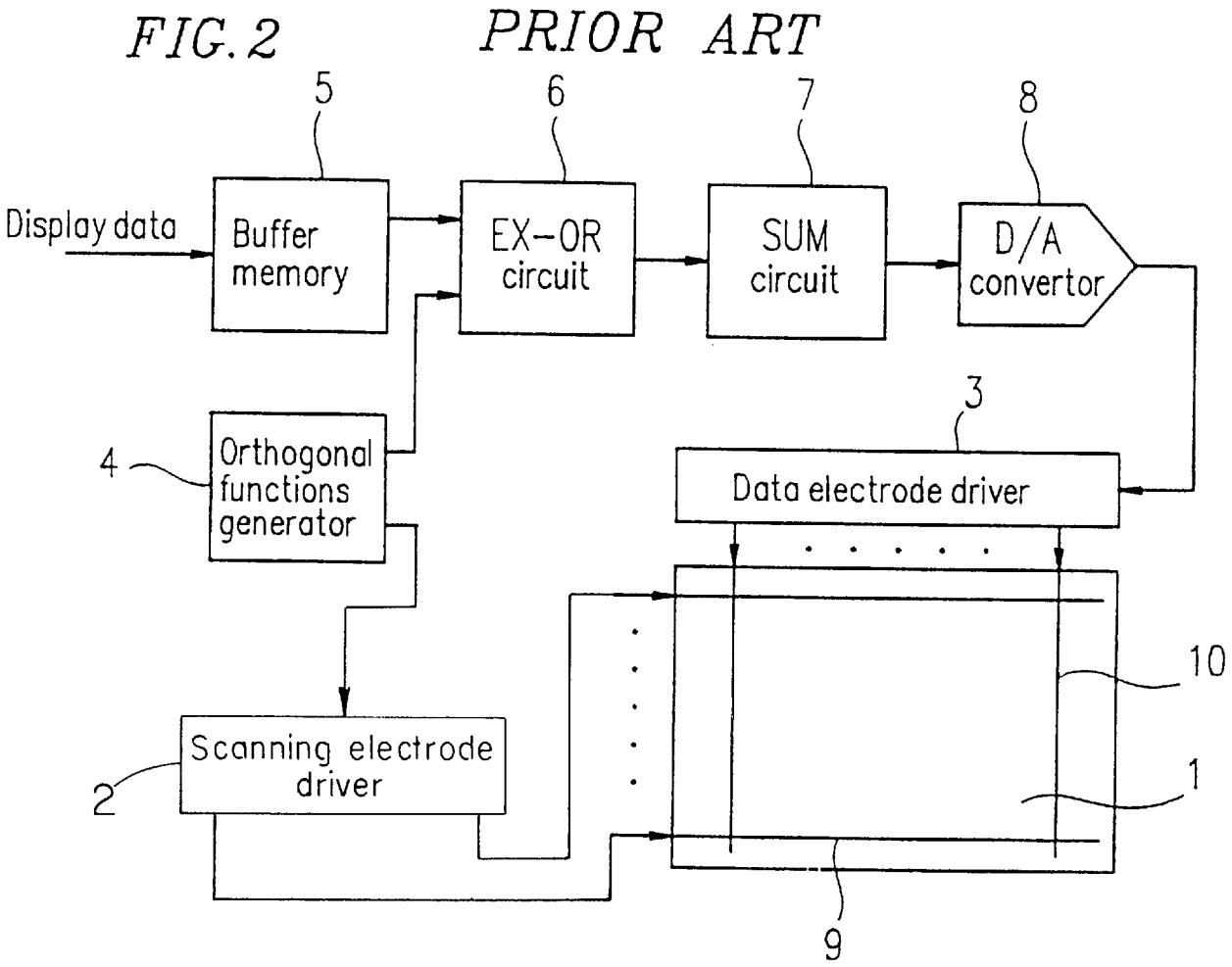
FIG. 2 PRIOR ART
FIG. 2 is a block diagram showing an exemplary configuration of a conventional driving circuit using the IHAT.
Figure 3:
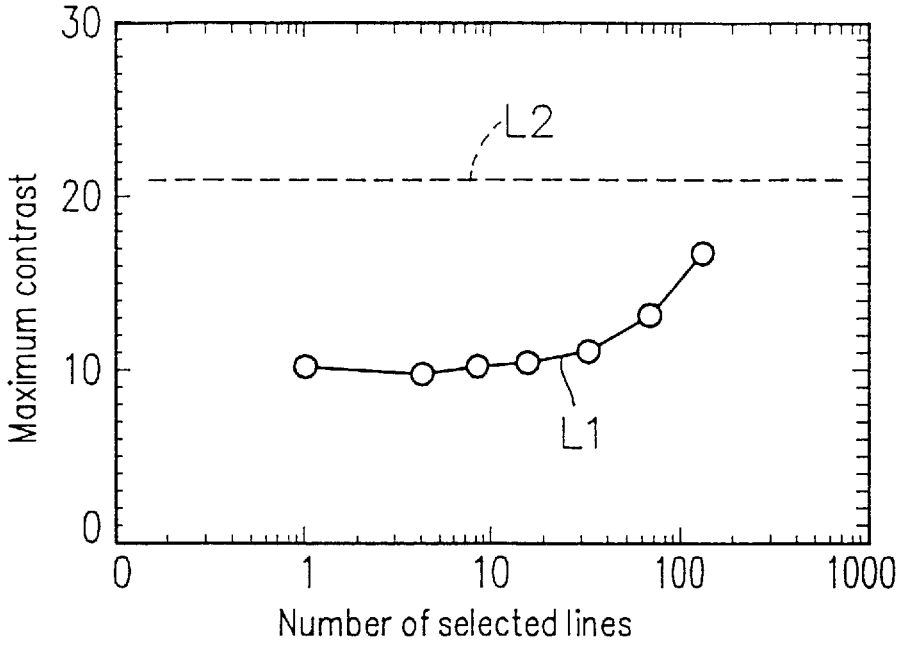
FIG. 3 PRIOR ART
FIG. 3 is a graph showing the relationship between the number of simultaneously selected lines and a contrast, in the case where the IHAT is applied to a fast-response liquid crystal display panel.
Figure 6:
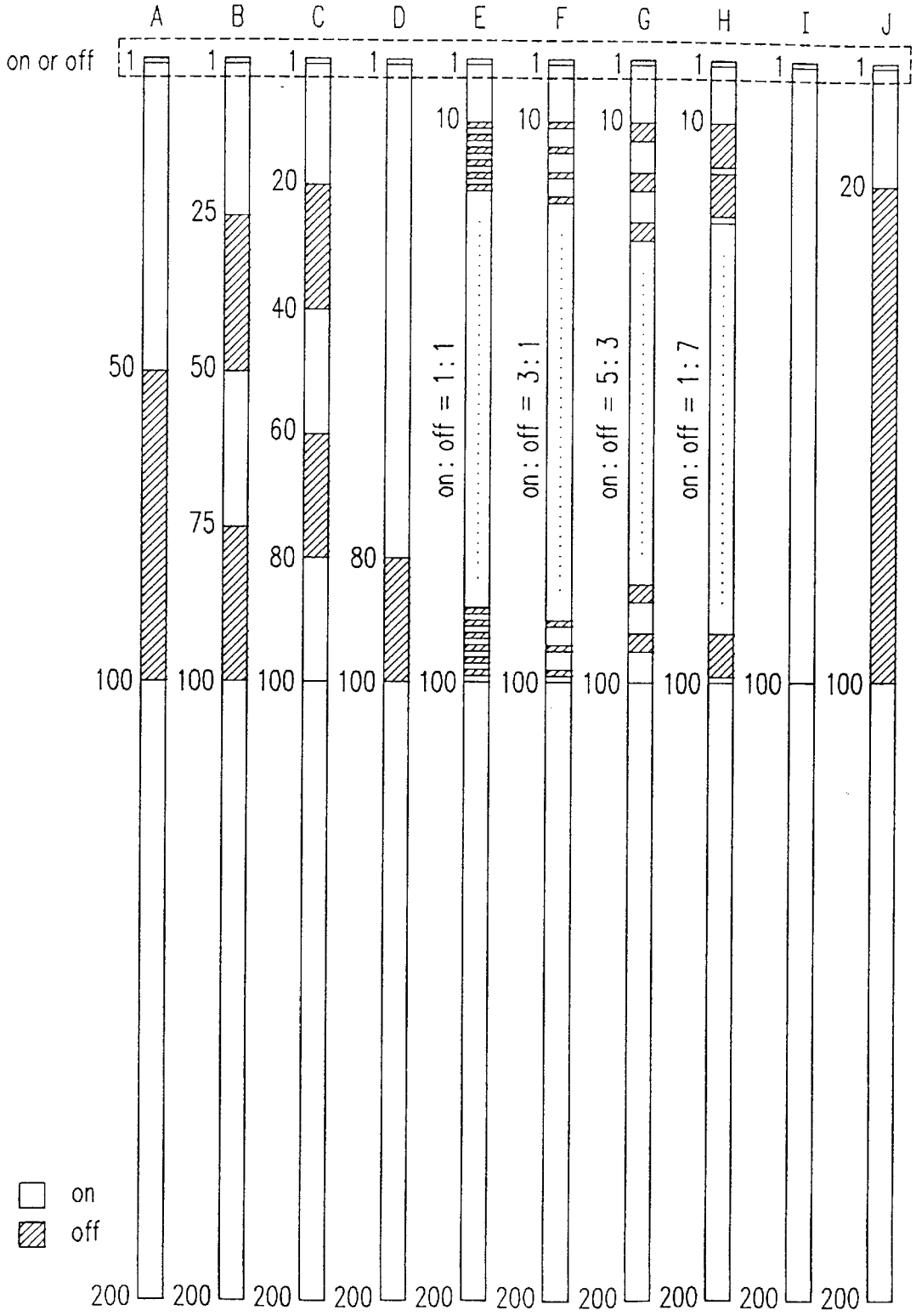
FIG. 6 is a schematic diagram showing display patterns used for optical measurement.
Figure 7A:
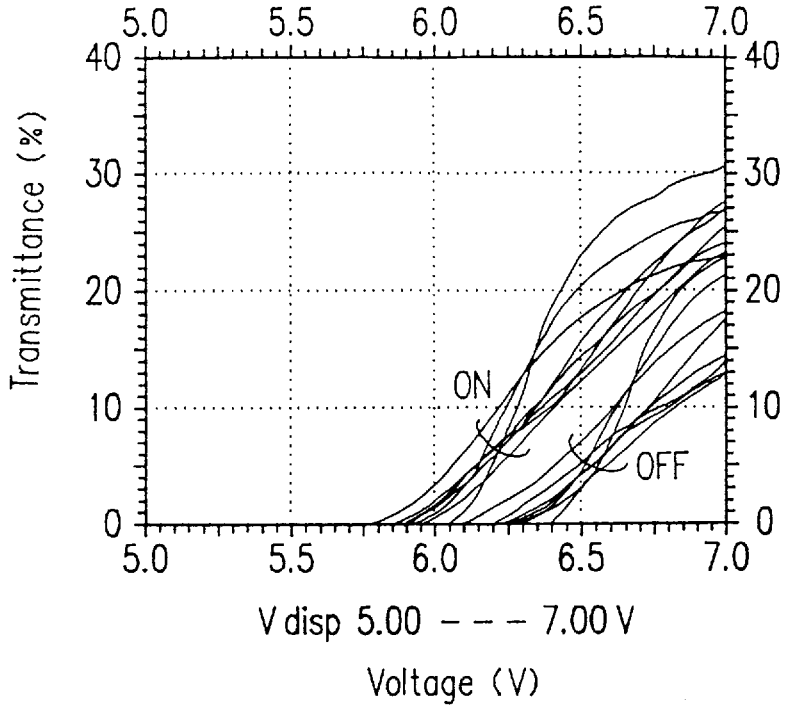
FIGS. 7A and 7B are graphs each showing transmittance characteristics, in the case where the IHAT is applied to a fast-response liquid crystal display panel (response speed $\tau$=100 ms).
Figure 7B:
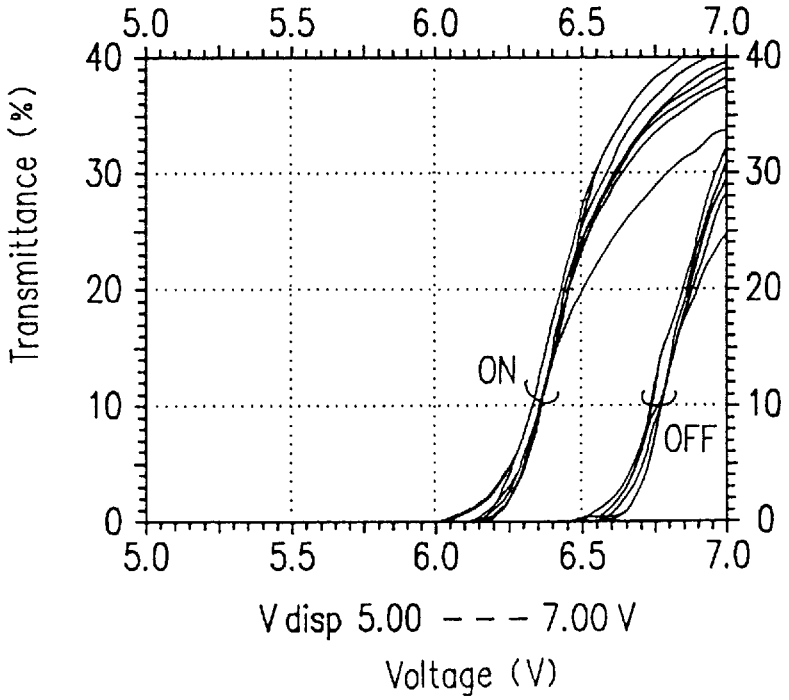
Figure 8A:
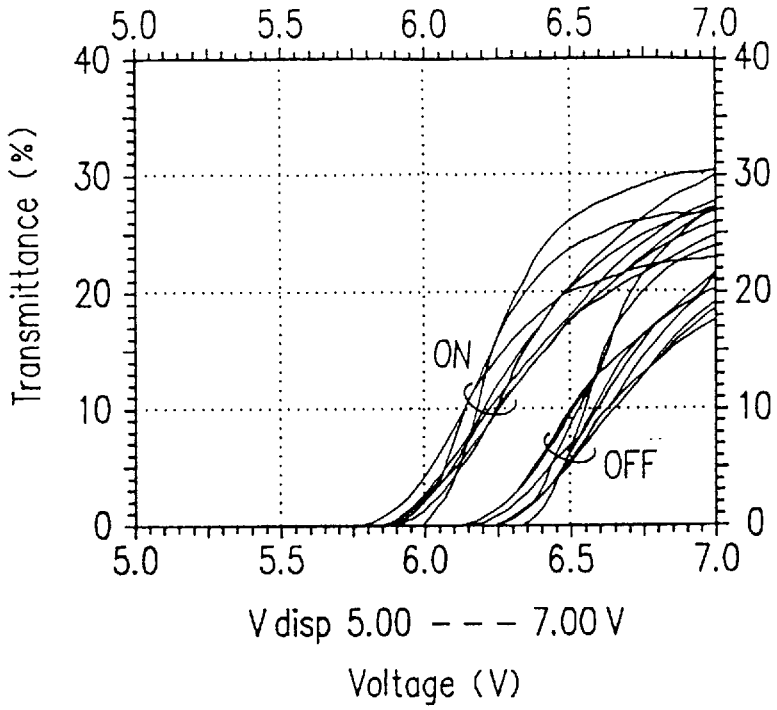
FIGS. 8A and 8B are graphs each showing transmittance characteristics, in the case where the IHAT is applied to a fast-response liquid crystal display panel (response speed $\tau$=140 ms).
Figure 8B:
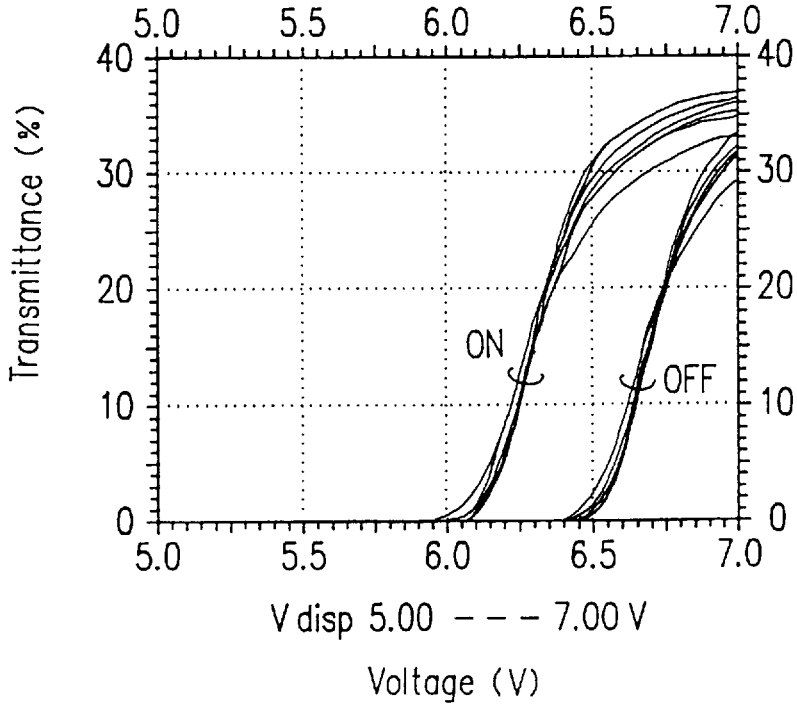

A characteristic curve L3 of FIG. 12 represents the change in contrast in a case where the bias value A is set so as to obtain the maximum contrast in the respective number of selected scanning electrodes 123. A characteristic curve L4 represents the change in contrast in a case where the LCD is driven with a rectangular wave of 300 Hz in the same way as in the conventional example described referring to FIG. 3. It is noted that the characteristic curve L4 corresponds to the line L2 of FIG. 3. A characteristic curve L5 represents the change in contrast in a case where the bias value A is fixed by the conventional driving method. It is noted that the characteristic curve L5 corresponds to the line L1 of FIG. 3.

According to the driving method of the present example, in any number of the selected lines, a contrast is increased by about 50% compared with the IHAT based on the conventional optimum bias method. In particular, when the number of selected lines is set to be 128, which is a half of the total number of the scanning electrodes 123 (i.e., 256), the characteristic curve L3 of FIG. 12 representing the contrast characteristic obtained by the driving method of the present example exhibits a contrast at almost the same level as that of the characteristic curve L4 obtained by driving the LCD with a square wave; Specifically, they provide almost equal characteristics. Consequently, display performance with a high contrast having less frame response phenomenon can be realized in the present example.

Particularly in the above case, the number of simultaneously selected scanning electrodes 123 is a half of the total number of the scanning electrodes 123. The buffer memory 128 may have a memory capacity corresponding to the number of simultaneously selected electrodes 123. Thus, according to the driving method of the present example, a required buffer memory capacity may be about a half of that of the AAM and the SAT which require a buffer memory having a memory capacity corresponding to the total number of the scanning electrodes 123. This allows the driving method of the present example to enable the miniaturization of a circuit size and the simplification of the circuit configuration.

The driving method of the present example has been described by way of an illustrative example of the liquid crystal display panel having N (=256) scanning electrodes. According to the results of various experiments conducted by the inventors, a high contrast can be obtained even by using liquid crystal display panels having the different number of scanning electrodes, when the bias value A is more than 1/16 and less than 1/4. That is, a satisfactory contrast can be obtained by setting the bias value A in the following range:

$$(1/\sqrt{N}) < A \leqq (1/\sqrt{N})\cdot 4 \tag{12}$$

In particular, when the number L of simultaneously selected scanning electrodes 123 is set to be substantially a half of the total number of the scanning electrodes 123, i.e., about N/2, a satisfactory contrast characteristic with less frame response phenomenon can be obtained.

Furthermore, when the twist angle of the orientation of liquid crystal molecules is set in the range of 180° to 270°, the same effects as those described above can be obtained; when the response speed is 120 ms or less, the same effects as those described above can also be obtained.

According to the present example, in the LCD 121 having the simple matrix LCD panel 122 having N scanning electrodes 123 disposed in parallel with each other and M data electrodes 124 disposed in parallel with each other so as to cross the scanning electrodes 123, the scanning electrodes 123 are divided into sub-groups each containing a predetermined number L of scanning electrodes 123 and each sub-group is successively driven by utilizing an orthogonal function. At this time, a scanning signal voltage of ±Vr is applied to selected scanning electrodes 123 and a scanning signal voltage of 0 volt is applied to non-selected scanning electrodes 123. A data signal voltage to be applied to the data electrodes 124 has an electric potential proportional to the sum of products of a display pattern and a scanning signal voltage, where the bias value A, i.e., a proportional constant is set to be less than 1/4 and more than 1/16.

That is, the bias value A is set so as to satisfy the following relationship:

$$(1/\sqrt{N}) < A \leqq (1/\sqrt{N})\cdot 4 \tag{13}$$

Furthermore, the number L of simultaneously selected scanning electrodes 123 is set to be substantially a half of the total number of the scanning electrodes 123.

The above setting enables a high response and a high contrast; as a result, LCDs capable of displaying a satisfactory image with a high contrast can be obtained even when incorporating a fast-response liquid crystal display panel. Thus, even when an image is displayed at an ordinary frame frequency (about 50 to 60 Hz) in the fast-response STN-LCDs, a frame response phenomenon can be eliminated so as to obtain a high quality liquid crystal display without involving the decrease in contrast.

In addition, the capacity of a buffer memory storing image data during orthogonal transformation operation may correspond to the number L of simultaneously selected scanning electrodes, where the number L is less than the total number N of the scanning electrodes. Furthermore, a proportional constant setting circuit which is to be newly added can be implemented with a simple construction using an operation amplifier or the like. Because of this, the entire device can be miniaturized and simplified, which results in the reduction of a production cost and power consumption thereof.

Example 2

Hereinafter, the second example according to the present invention will be described. FIG. 13 is a diagram showing an exemplary orthogonal function in a driving method of the present example. It should be noted that the orthogonal function is not limited to that shown in FIG. 13.

In the present example, 16 scanning electrodes (F1 to F16) are divided into blocks each consisting of L which is smaller than the total number of scanning electrodes, e.g., 4 scanning electrodes. Each block is further divided into groups each consisting of a plurality of scanning electrodes whose number is smaller than L (for example, upper two rows and lower two rows in each block as shown in FIG. 13). Then, the following processing is performed.

A series of selection pulse (1 or −1) strings according to an orthogonal function are successively applied to each group per predetermined period (e.g., ¼ of T in FIG. 13) obtained by dividing a division period T of one frame period $T_F$ for displaying one screen. During the other periods in which a selection pulse is not applied, a voltage at a predetermined level (e.g., 0 volt) is applied to each scanning electrode. On the other hand, a voltage corresponding to the sum of products of an orthogonal function and display data is applied to each data electrode.

The above-mentioned series of processings are performed with respect to all of the blocks with a timing shift in one frame period $T_F$. Thus, the above-mentioned signal waveform is applied to each pixel in one frame period $T_F$, whereby one screenful of display is performed.

As described above, according to the driving method of the present example, a period required for an orthogonal property to be established corresponds to the division period T. Thus, in the present example, a period required for an orthogonal property to be established is shorter than that of the AAM and the SAT in which one frame period is required for an orthogonal property of each scanning electrode to be established. Because of this, even in fast-response display panels, display inconsistencies involved in the prior art can be prevented from occurring and a uniform display characteristic with a high contrast can be realized. The elimination of the display inconsistencies is also advantageous for performing a gray scale display.

The SAT and the AAM requires one frame's worth of buffer memory according to their driving principles, whereas the driving method of the present example requires a buffer memory which is a half or less of that of the SAT and the AAM. In addition, the AAM requires a circuit size capable of performing an operation corresponding to the total number of the scanning electrodes, whereas the driving method of the present example only requires a circuit size capable of performing an operation corresponding to the number of simultaneously selected scanning electrodes. Accordingly, the driving method of the present example is more advantageous in terms of a circuit size and a cost, compared with the conventional methods.

In the driving method of the present example, as shown in FIG. 13, a selection pulse is dispersed and applied to the scanning electrodes at a plurality of timings during one frame period T. This makes it possible to substantially simplify a circuit configuration (an operation circuit, an orthogonal function generating circuit, etc.) and to reduce power consumption.

Since the total number of levels of a voltage of a data electrode driving circuit (data electrode driver) increases in proportion to the number of simultaneously selected scanning electrodes, the IHAT and the AAM require an expensive analog driver. In contrast to this, according to the driving method of the present example, the number of simultaneously selected scanning electrodes is not so large as that of the IHAT and the AAM; therefore, a less expensive multi-level driver can realize the method.

Figure 14A:
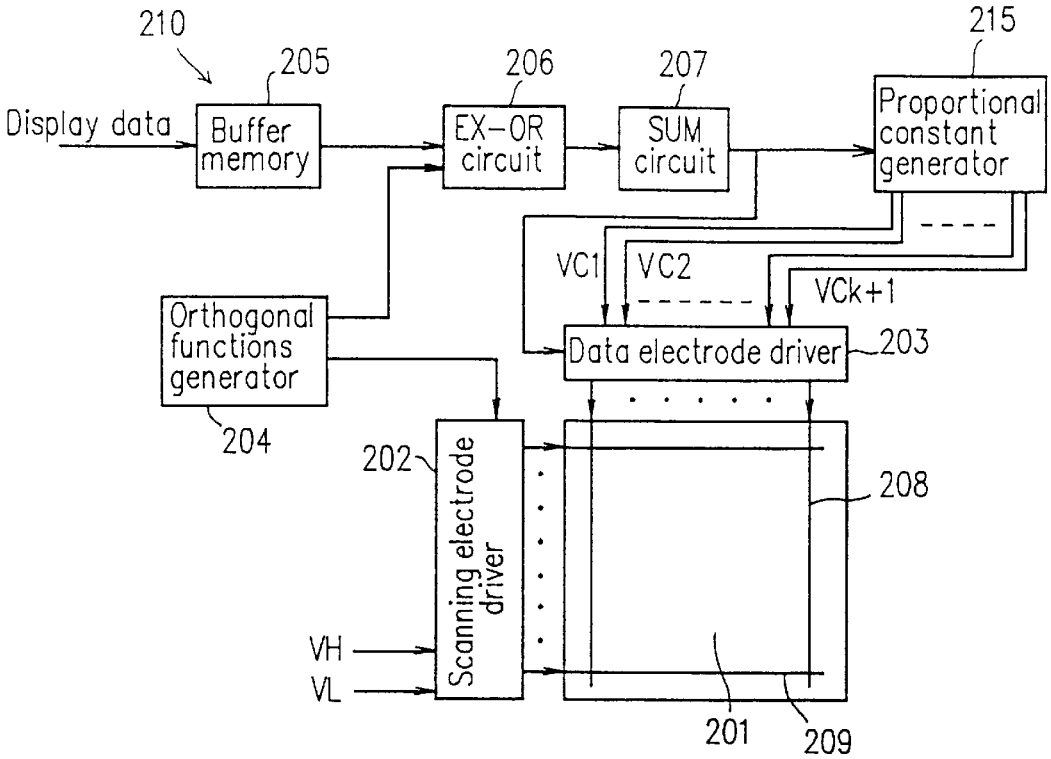
FIG. 14A is a block diagram showing the configuration of an LCD of Example 2 according to the present invention.

FIG. 14A is a block diagram showing the configuration of an LCD 210 of the present example. The LCD 210 is provided with a liquid crystal display panel 201 having N scanning electrodes 209 and M data electrodes 208. The scanning electrodes 209 are respectively connected to a scanning electrode driving circuit (scanning electrode driver) 202, and the data electrodes 208 are respectively connected to a data electrode driving circuit (data electrode driver) 203. The scanning electrode driver 202 outputs a signal potential of +Vr or −Vr for a selection and a predetermined constant potential, e.g., a signal potential of 0 volt for a nonselection to the respective scanning electrodes 209, based on orthogonal function data from an orthogonal function generating circuit 204. These potentials are output so as to obtain patterns shown in FIGS. 13 and 15.

Display data supplied from outside is once stored in a buffer memory 205 having a capacity corresponding to L selected scanning electrodes 209. Thereafter, output data of K bits corresponding to K selected scanning electrodes 209 in one block including L scanning electrodes and the function data of K bits from the orthogonal function generating circuit 204 are input to an exclusive OR (EX-OR) circuit 206. The EX-OR circuit 206 compares the output data with the function data on a bit-by-bit basis. Then, an adder (SUM circuit) 207 calculates the total number of bits in which the output data is not matched with the function data (i.e., number of mismatchings).

The calculated result is sent to the data electrode driver 203 and to the proportional constant setting circuit 215. One of (k+1) voltages ($VC_1$ to $VC_{k+1}$) generated by the proportional constant setting circuit 215 based on display data is selected and output as a data signal voltage so as to be applied in unison to each of the data electrodes 208 per predetermined period. Thus, one frame's worth of data processing and voltage application are conducted and an input display image pattern is reproduced on the liquid crystal display panel 201.

The LCD 210 adopting the driving method of the present example uses the proportional constant setting circuit 215 for obtaining a high contrast as described above.

Figure 14B:
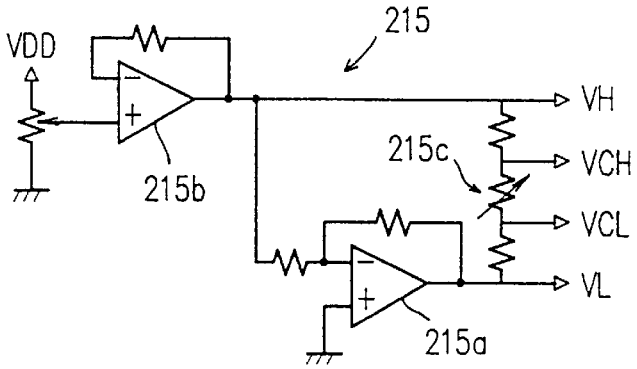
FIG. 14B is a circuit diagram showing an exemplary circuit configuration of a proportional constant setting circuit 215.

FIG. 14B is an exemplary circuit configuration of the proportional constant setting circuit 215. The proportional constant setting circuit 215 shown in FIG. 14B includes the combination of known amplifying circuits 215*a* and 215*b* made of an operation amplifier and the like. Its output portion is formed of the combination of a variable resistor 215*c* and an appropriate number of fixed resistors. By varying the value of the variable resistor 215*c*, the level of an output voltage is set to be appropriately at either of the levels $VC_1$, through $VC_{k+1}$ in the range of VCH to VCL.

Figure 14C:
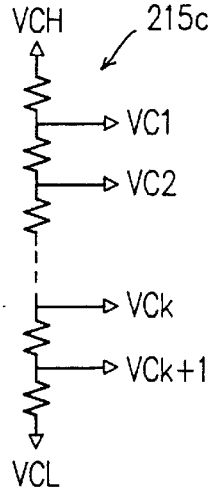
FIG. 14C is a diagram schematically illustrating the setting of an output voltage level by variable resistance.

FIG. 14C is a diagram schematically illustrating the setting of the level of an output voltage by the variable resistor 215*c*. As shown in FIG. 14C, the amplification rate of the output voltage is arbitrarily set by appropriately varying the value of the variable resistor 215*c*, whereby the level of the output voltage can be set to be any of levels $VC_1$ to $VC_{k+1}$ between the predetermined voltage levels VCH and VCL.

Figure 14D:
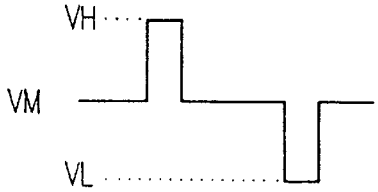
FIG. 14D is a diagram showing an exemplary driving waveform of a scanning electrode driving circuit.
Figure 14E:
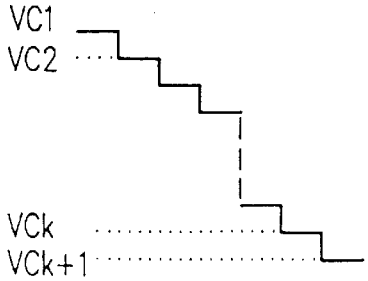
FIG. 14E is a diagram showing an exemplary driving waveform of a data electrode driving circuit.

FIG. 14D is an exemplary driving waveform of a scanning electrode driving circuit; FIG. 14E is an exemplary driving waveform of a data electrode driving circuit.

In the above description and FIGS. 14A through 14E, VDD denotes a power supply voltage; VH and VL denote selection voltage levels of the scanning electrode driving circuit; VM is a non-selection voltage level of the scanning electrode driving circuit; and $VC_1$, to $VC_{k+1}$ are output voltage levels of the data electrode driving circuit.

Figure 15:
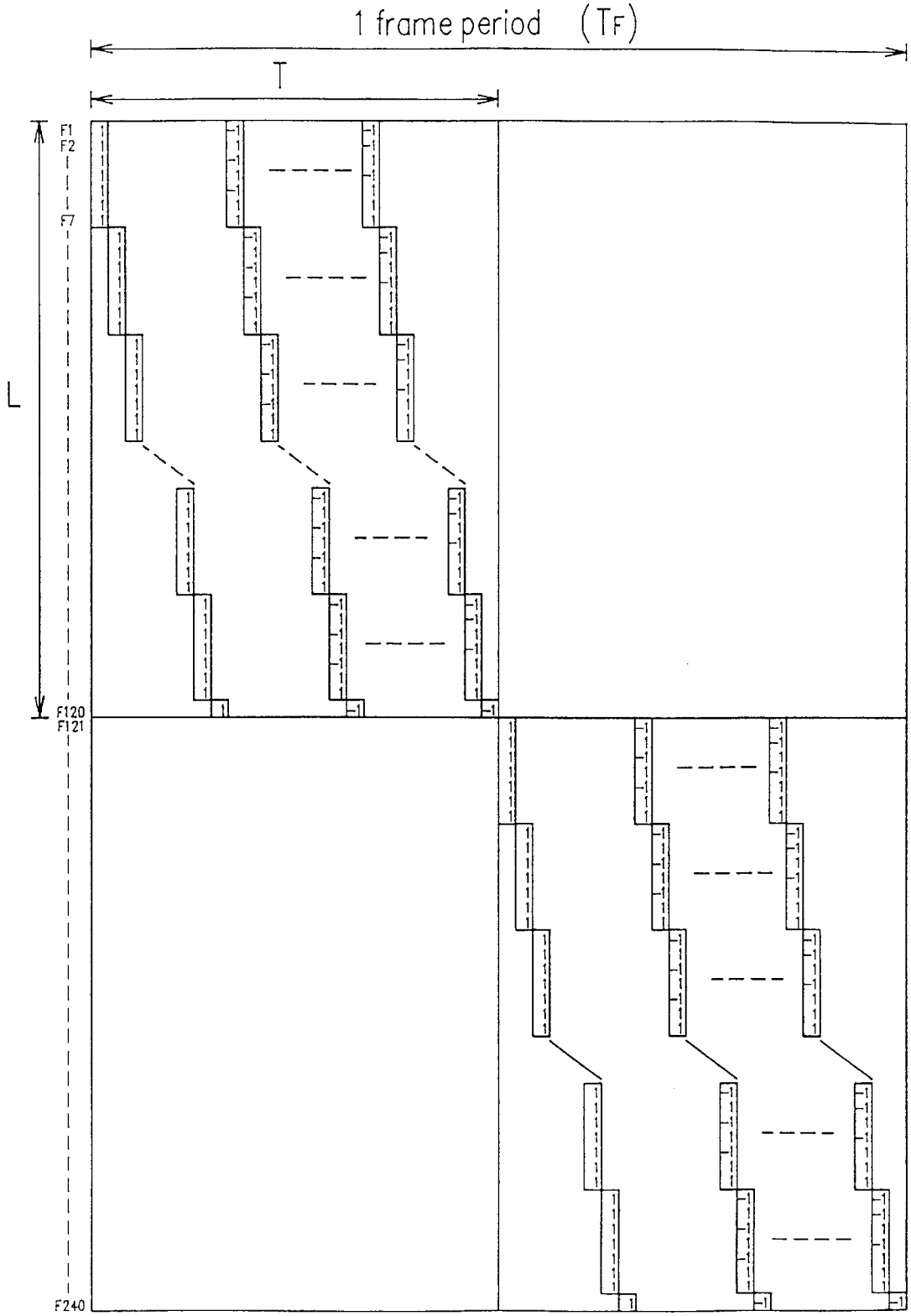
FIG. 15 is a diagram showing another exemplary driving pattern (pattern of an orthogonal function) used in Example 2 according to the present invention.

A driving pattern (pattern of an orthogonal function) which can be used in the present example is not limited to that shown in FIG. 13. Various patterns, which are obtained by modifying the number L of scanning electrodes in one block, the number K of simultaneously selected scanning electrodes among the L scanning electrodes, the number of blocks with respect to the entire scanning electrodes, the number of division of one frame period $T_F$ and the like, can be used. FIG. 15 shows another exemplary driving pattern. Specifically, FIG. 15 shows an exemplary function used for orthogonal transformation of a display pattern in a case where the total number N of scanning electrodes (F1 to F240) is 240, the size L of one block is 120, and the number of simultaneously selected scanning electrodes is 7. In this case, the number of groups per block is 18 and the division period T is divided into 144 selection pulse application periods. In the orthogonal function pattern shown as a matrix of 240×288 in FIG. 15, all of the components other than 1 and −1 are 0.

FIG. 16 is a diagram showing an exemplary 8-order WALSH function used for generating a selection pulse string to be applied during each division period T of the driving pattern shown in FIG. 15. Actually used WALSH functions are not limited to that having components shown in FIG. 16. The components of the WALSH function can be replaced on a row or column basis, and positive or negative signs (+ or −) can be replaced on a row basis, so that a higher quality display may be achieved.

Hereinafter, features of the driving method of the present example and advantages obtained therefrom will be described by exemplifying specific numerical values.

In the present example, an STN liquid crystal display element having a response time τ of 100 ms and the number N of row-scanning electrodes of 240 is driven by varying the number K of simultaneously selected scanning electrodes under the conditions that the number L of scanning electrodes included in one block is 120, a frame frequency F is 60 Hz, and a bias is ⅛.

Figure 17:
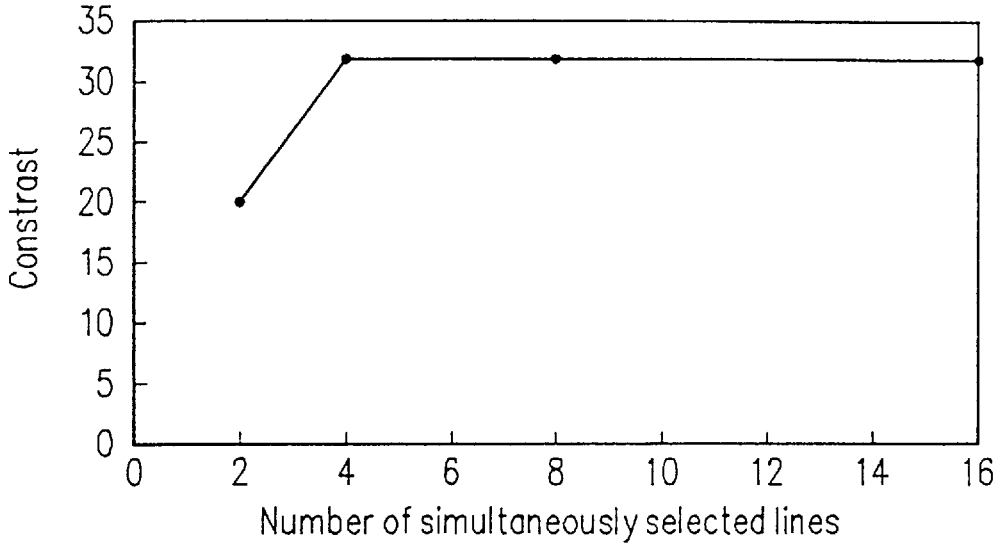
FIG. 17 is a graph showing the relationship between the number of simultaneously selected lines and a contrast in Example 2 according to the preset invention.

FIG. 17 is a graph showing the relationship between the number K of simultaneously selected scanning electrodes (horizontal axis) and a contrast (vertical axis) in a case where pixels in the upper one line of a liquid crystal display panel is allowed to perform a white or black display and the remaining pixels are allowed to perform a white display. As is understood from FIG. 17, the contrast is almost saturated at K=4 or more.

The level of K greatly influences a circuit size and a cost, so that it is preferably set as small as possible. However, when the number L of scanning electrodes included in one block decreases, the amplitude of a driving signal to be applied to the scanning electrodes is likely to increase. Thus, the number K of simultaneously selected scanning electrodes needs to be determined considering required anti-high voltage capability of the driving circuit and the like.

Example 3

In the present example, an STN liquid crystal display element having a response time τ of 100 ms and the number N of row scanning electrodes of 240 is driven by varying a bias value A under the condition that the number K of simultaneously selected scanning electrodes is 7 and a frame frequency F is 60 Hz. The STN liquid crystal display element is driven in two cases where the number L of scanning electrodes included in one block is 120 and where the number L thereof is 60.

Figure 18:
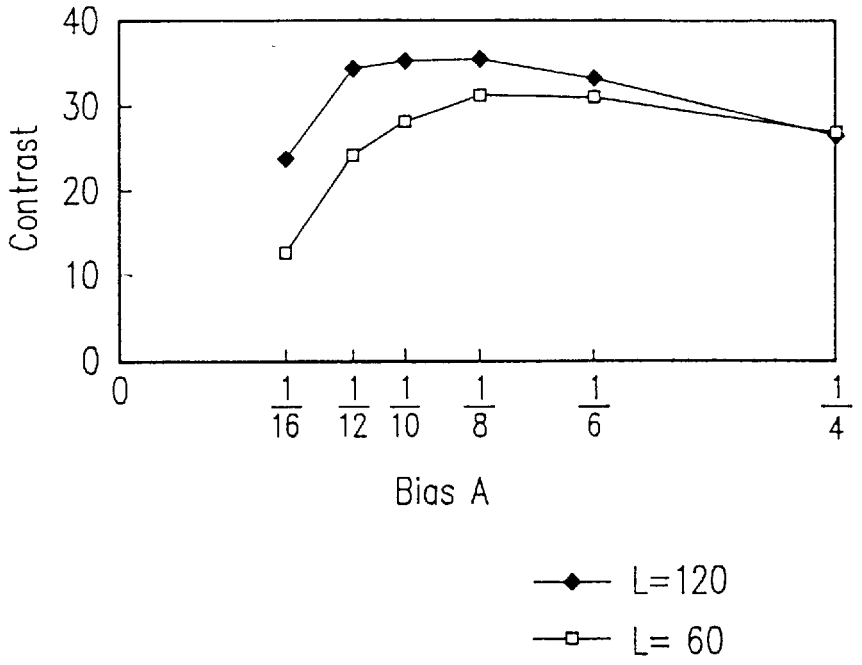
FIG. 18 is a graph showing the relationship between a proportional constant and a contrast in Example 3 according to the present invention.

FIG. 18 is a graph showing the relationship between a bias value A (horizontal axis) and a contrast (vertical axis) in a case where the liquid crystal display element is driven under the above-mentioned condition. According to the conventional optimum bias method, the maximum contrast is obtained approximately at A=1/16. In contrast to this, according to the driving method of the present example, as is understood from FIG. 18, a contrast reaches its peak approximately at A=⅛ which is larger than that of the optimum bias method, in both cases of L=60 and 120. Furthermore, even when the bias value A is ¼, the contrast is higher than that at A=1/16.

In the present example, assuming that the number of scanning electrodes is N, the number of data electrodes is M, a voltage waveform applied to the i-th scanning electrode ($1 \leqq i \leqq N$) is Fi(t), a voltage waveform Gj(t) applied to the j-th data electrode ($1 \leqq j \leqq M$) is given by the following equation (14), and a proportional constant A is preferably set in the range of $1/\sqrt{N} < A \leqq (1/\sqrt{N}) \cdot 4$.

$$Gj(t) = A \cdot \sum_{i=1}^{N} (Fi(t) \cdot Iij) \tag{14}$$

where Iij is a display pattern of a pixel determined by the i-th scanning electrode and the j-th data electrode.

Example 4

The present example shows exemplary measurement results of optical characteristics obtained by driving an STN liquid crystal display element having a response time τ of 100 ms and the number N of row scanning electrodes of 240 in two cases where the number L of scanning electrodes included in one block is 60 and where the number L is 120. For comparison, optical characteristics obtained by driving the same liquid crystal display element by the SAT under the same condition as the above will be shown.

Figure 19:
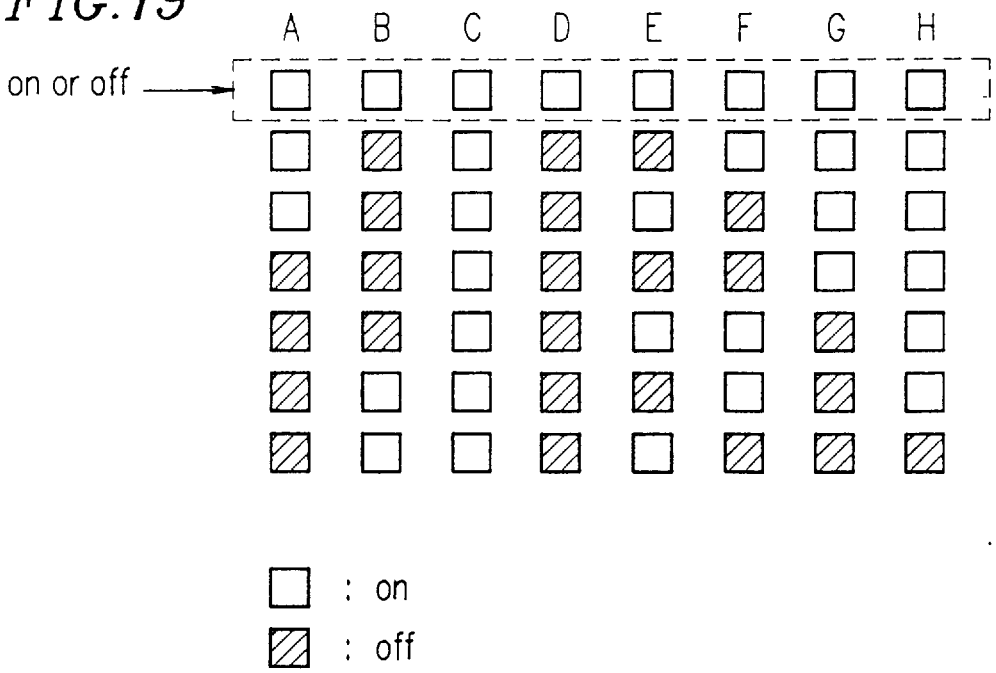
FIG. 19 is a diagram showing a display pattern used in Example 3 according to the present invention.

FIG. 19 shows a display pattern used in the present example. This pattern is given to pixels of the upper 7 lines in the liquid crystal display panel, and the remaining pixels are allowed to perform a white display.

Furthermore, parts of elements of the orthogonal function are replaced in a column direction and/or a row direction so as to form three kinds of distribution states of bias voltages. In this case, it is assumed that the number K of simultaneously selected scanning electrodes is 7, a frame frequency F is 60 Hz, and a proportional constant A is ⅛.

First, a driving waveform of an ON display in a case where a bias voltage is concentrated will be described. FIGS. 20A through 20H are diagrams respectively showing driving waveforms with respect to display patterns A through H in a case where the number L of scanning electrodes included in one block is 60; FIG. 20I is a graph showing a transmittance characteristic in the respective cases shown in FIGS. 20A through 20H. Similarly, FIGS. 21A through 21H are diagrams respectively showing driving waveforms with respect to display patterns A through H in a case where the number L of scanning electrodes included in one block is 120; FIG. 21I is a graph showing a transmittance characteristic in the respective cases shown in FIGS. 21A through 21H. The display patterns A through H shown in FIGS. 20A through 20H and those shown in FIGS. 21A through 21H correspond to display patterns of the respective columns A through H shown in FIG. 19.

Figure 21A:
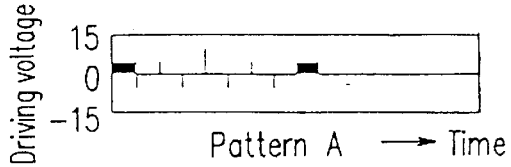
FIGS. 21A through 21H respectively show driving waveforms with respect to display patterns A through H in a case where the number of scanning electrodes L contained in one block is 120, under the condition that a bias voltage is concentrated in Example 4 according to the present invention.
Figure 21B:
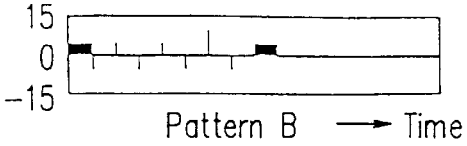
Figure 21C:
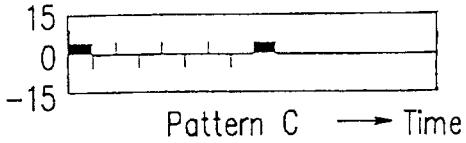
Figure 21D:
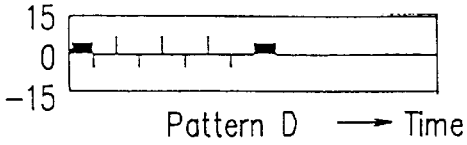
Figure 21E:
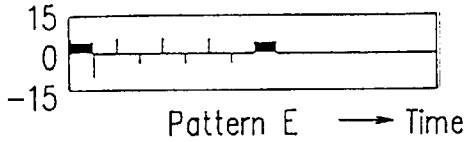
Figure 21F:
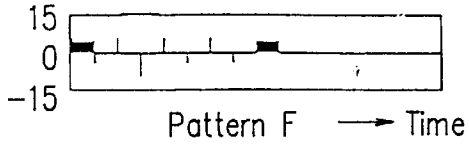
Figure 21G:
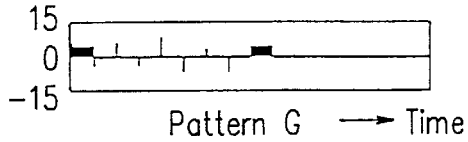
Figure 21H:
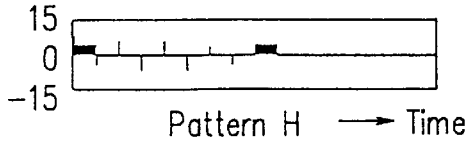
Figure 21I:
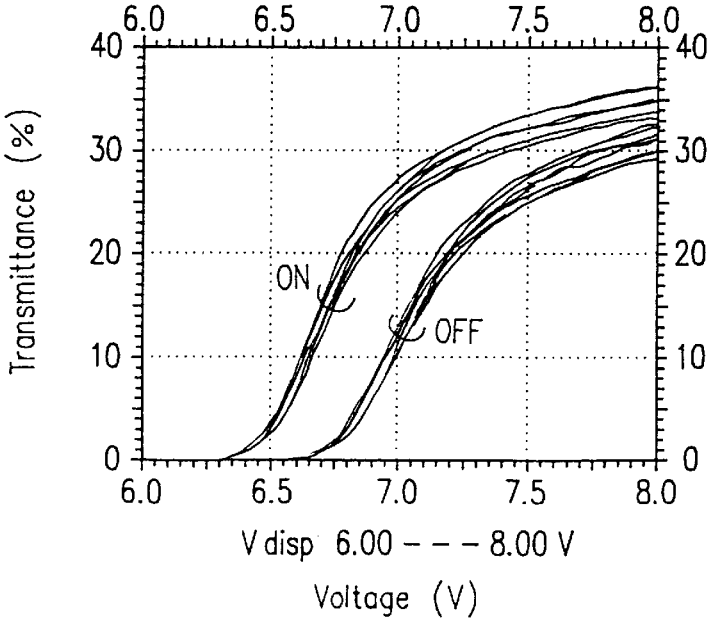
FIG. 21I is a graph showing transmittance characteristics in the respective cases shown in FIGS. 21A through 21H.
Figure 22A:
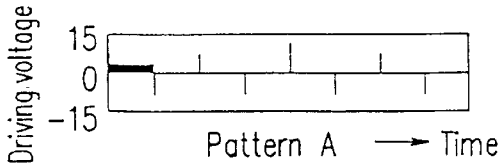
FIGS. 22A through 22H respectively show driving waveforms with respect to display patterns A through H in a case where an LCD panel of Example 4 according to the present invention is driven by the SAT while a bias voltage is concentrated.
Figure 22B:
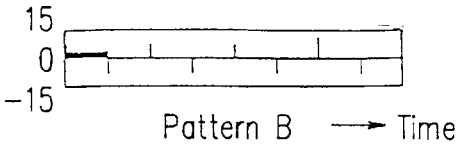
Figure 22C:
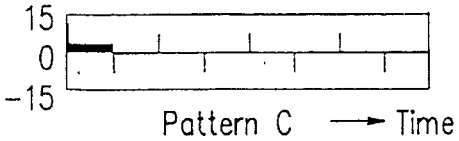
Figure 22D:
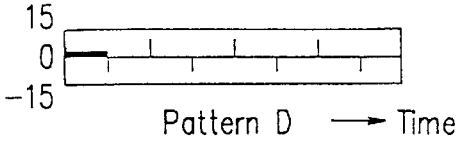
Figure 22E:
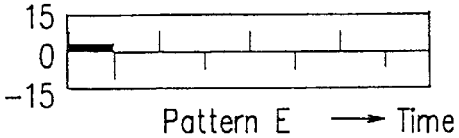
Figure 22F:
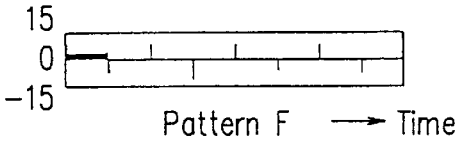
Figure 22G:
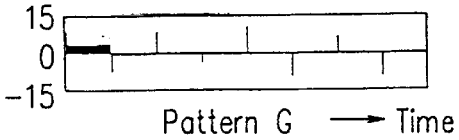
Figure 22H:
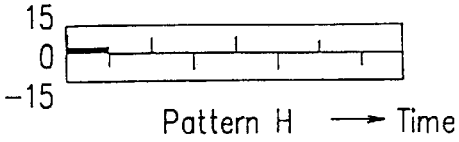
Figure 22I:
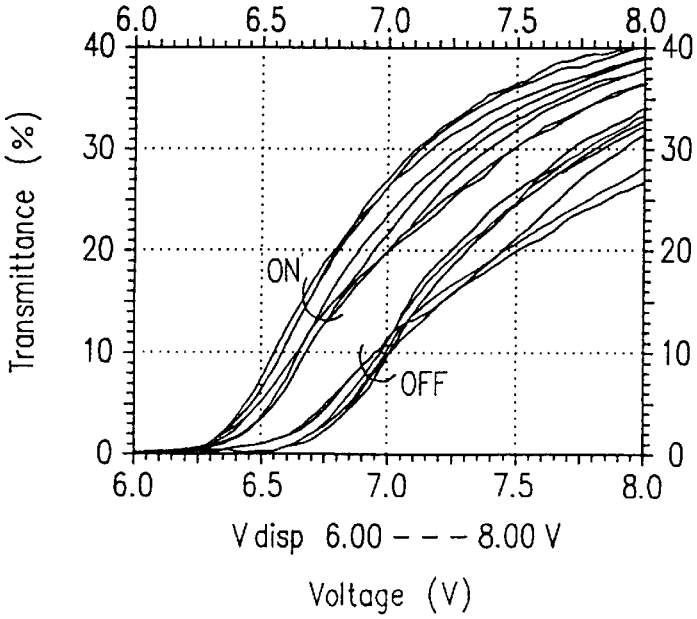
FIG. 22I is a graph showing transmittance characteristics in the respective cases shown in FIGS. 22A thorough 22H.

For comparison, FIGS. 22A through 22I show characteristics in a case where the same liquid crystal display panel as the above is driven by the SAT. FIGS. 22A through 22H are diagrams respectively showing driving waveforms with respect to display patterns A through H; FIG. 22I is a graph showing transmittance characteristic in the respective cases shown in FIGS. 22A through 22H. FIGS. 22A thorough 22I correspond to FIGS. 20A through 20I or FIGS. 21A through 21I.

According to the SAT, as represented by the driving voltage waveforms of FIGS. 22A through 22H, a bias voltage is concentrated in a part of one frame depending upon display data due to characteristics inherent in its driving principle. This causes decrease in an entire contrast due to a frame response phenomenon. Furthermore, as shown in FIG. 22I, transmittance values are varied depending upon display patterns, which is attributable to an orthogonal property of a function.

Figure 20A:
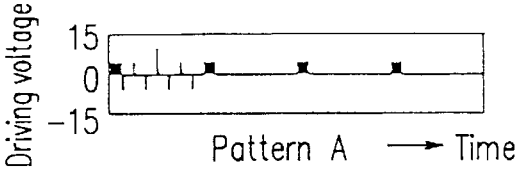
FIGS. 20A through 20H respectively show driving waveforms with respect to display patterns A through H in a case where the number of scanning electrodes L contained in one block is 60, under the condition that a bias voltage is concentrated in Example 4 according to the present invention.
Figure 20B:
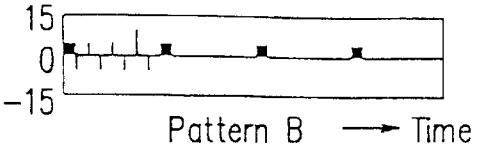
Figure 20C:
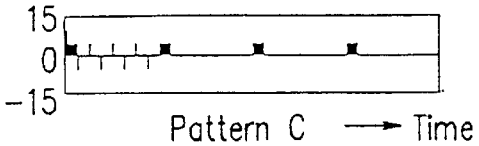
Figure 20D:
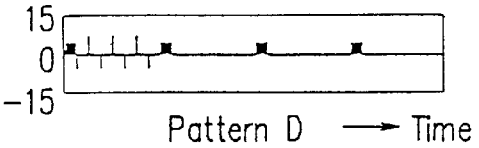
Figure 20E:
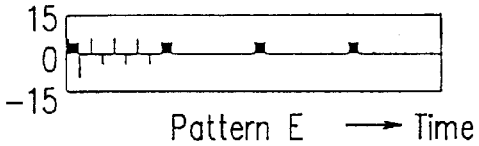
Figure 20F:
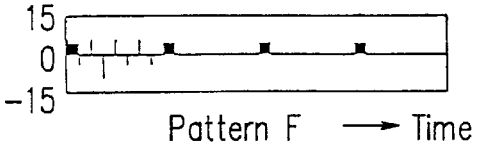
Figure 20G:
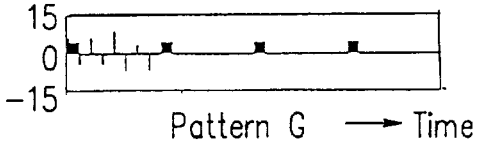
Figure 20H:
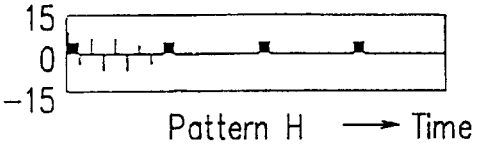
Figure 20I:
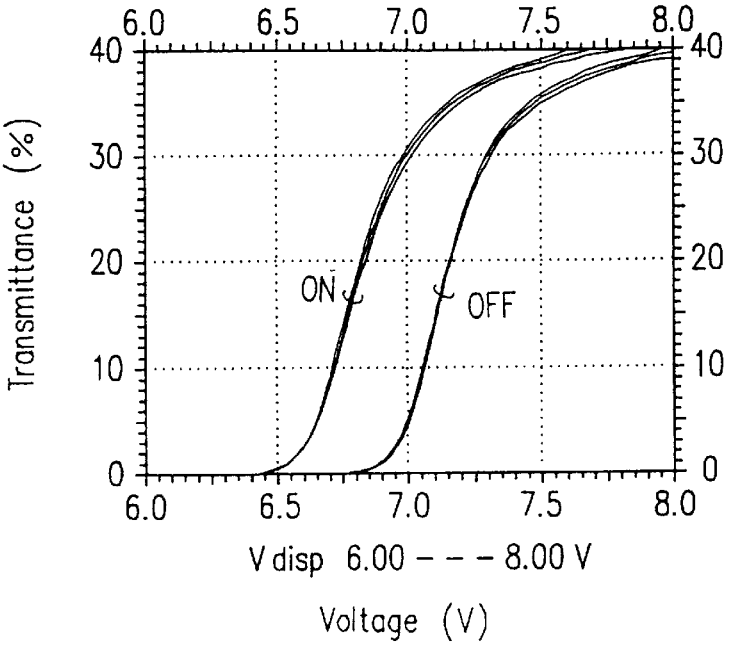
FIG. 20I is a graph showing transmittance characteristics in the respective cases shown in FIGS. 20A through 20H.

In contrast to this, according to the driving method of the present example, as shown in FIGS. 20A thorough 20H and 21A through 21H, driving waveforms are dispersed in one frame. Because of this, the decrease in contrast caused by the frame response phenomenon can be eliminated. Furthermore, according to the driving method of the present example, as shown in FIGS. 20I and 21I, the variation of transmittance can be eliminated. This is because the period required for an orthogonal property of a function to be established is shorter than that of the SAT.

Figure 23A:
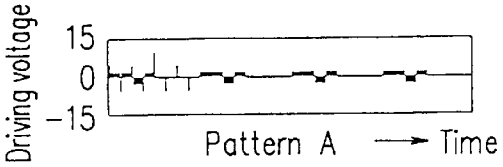
FIGS. 23A through 23H respectively show driving waveforms with respect to display patterns A through H in a case where the number of scanning electrodes L contained in one block is 60, under the condition that a bias voltage is dispersed in Example 4 according to the present invention.
Figure 23B:
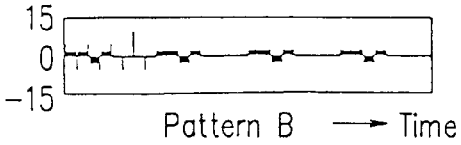
Figure 23C:
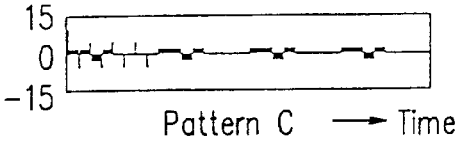
Figure 23D:
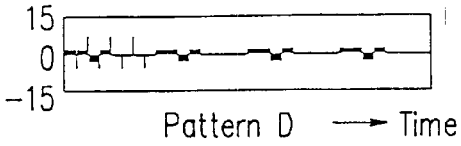
Figure 23E:
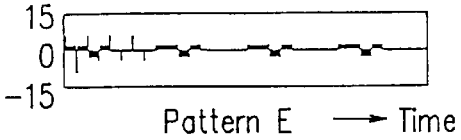
Figure 23F:
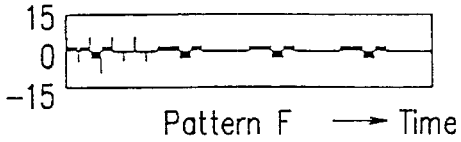
Figure 23G:
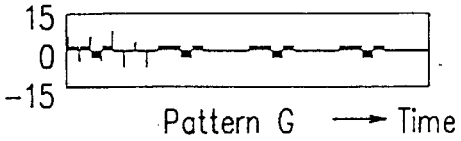
Figure 23H:
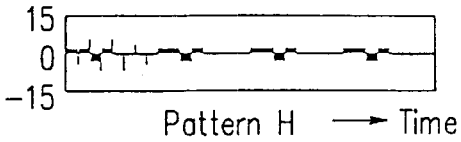
Figure 23I:
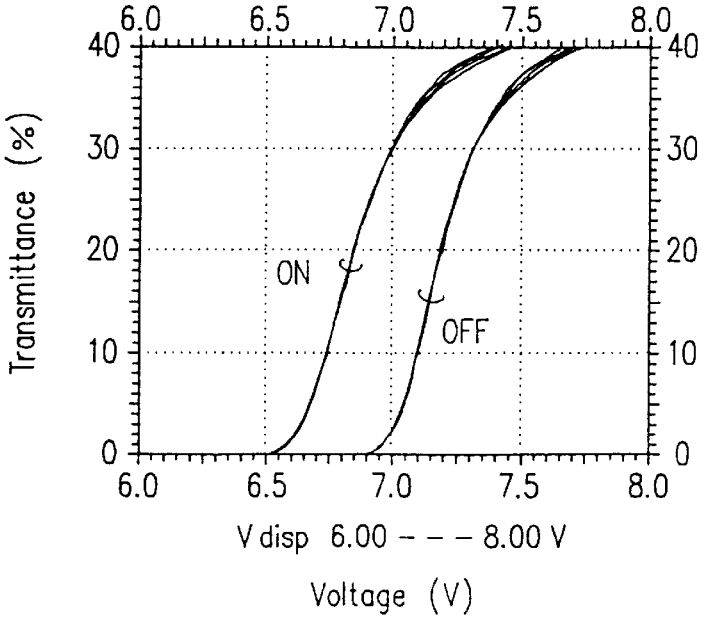
FIG. 23I is a graph showing transmittance characteristics in the respective cases shown in FIGS. 23A through 23H.
Figure 24A:
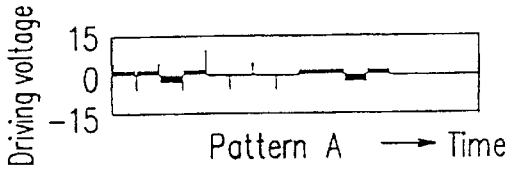
FIGS. 24A through 24H respectively show driving waveforms with respect to display patterns A through H in a case where the number of scanning electrodes L contained in one block is 120, under the condition that a bias voltage is dispersed in Example 4 according to the present invention.
Figure 24B:
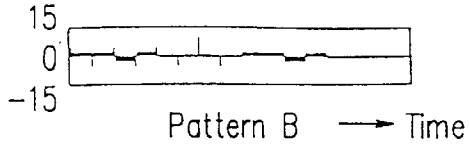
Figure 24C:
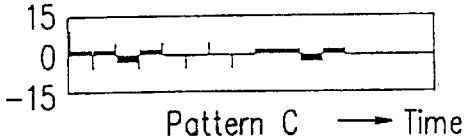
Figure 24D:
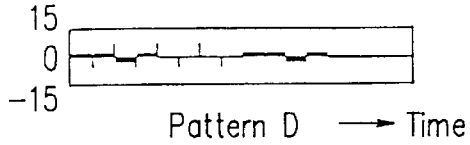
Figure 24E:
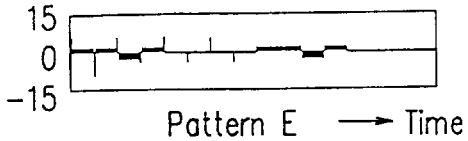
Figure 24F:
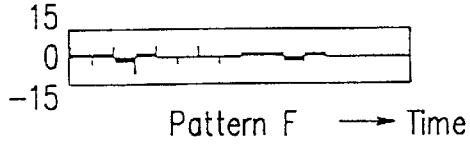
Figure 24G:
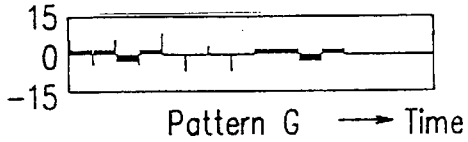
Figure 24H:
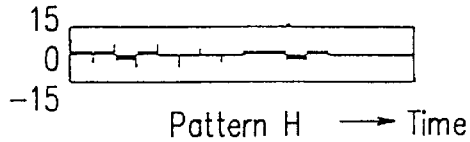
Figure 24I:
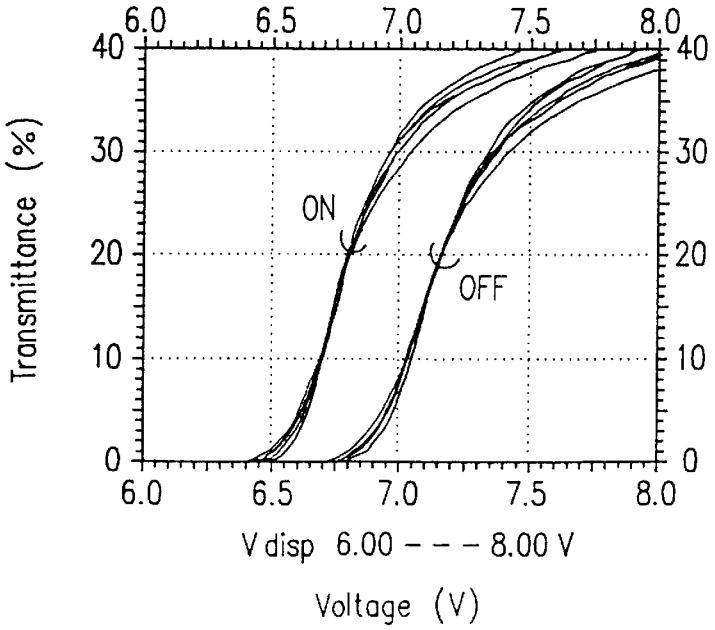
FIG. 24I is a graph showing transmittance characteristics in the respective cases shown in FIGS. 24A through 24H.

Next, a driving waveform of an ON display in a case where a bias voltage is dispersed will be described. FIGS. 23A through 23H are diagrams respectively showing driving waveforms with respect to display patterns A through H in a case where the number L of scanning electrodes included in one block is 60; FIG. 23I is a graph showing a transmittance characteristic in the respective cases shown in FIGS. 23A thorough 23H. Similarly, FIGS. 24A through 24H are diagrams respectively showing driving waveforms with respect to display patterns A through H in a case where the number L of scanning electrodes included in one block is 120; FIG. 24I is a graph showing a transmittance characteristic in the respective cases shown in FIGS. 24A through 24H. The display patterns A through H shown in FIGS. 23A through 23H and those shown in 24A through 24H correspond to the display patterns of the respective columns A through H shown in FIG. 19.

Figure 25A:
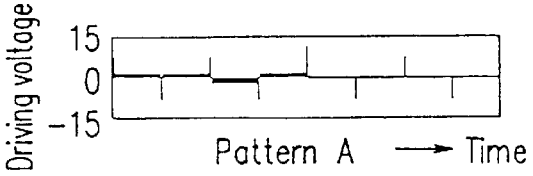
FIGS. 25A through 25H respectively show driving waveforms with respect to display patterns A through H in a case where an LCD panel of Example 4 according to the present invention is driven by the SAT while a bias voltage is dispersed.
Figure 25B:
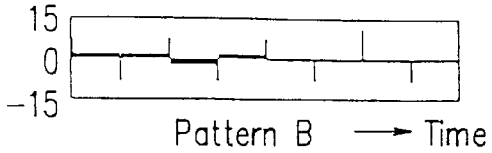
Figure 25C:
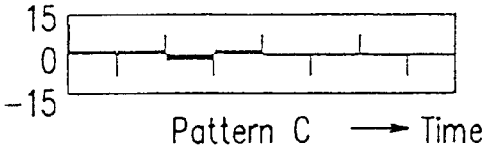
Figure 25D:
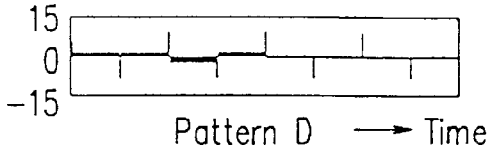
Figure 25E:
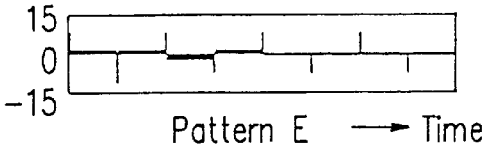
Figure 25F:
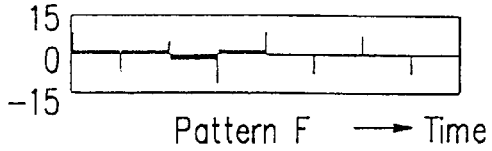
Figure 25G:
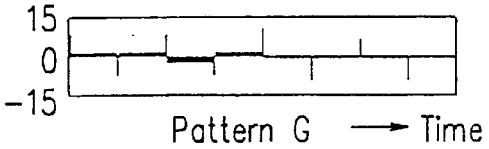
Figure 25H:
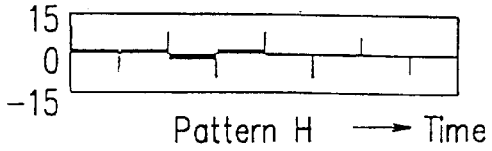
Figure 25I:
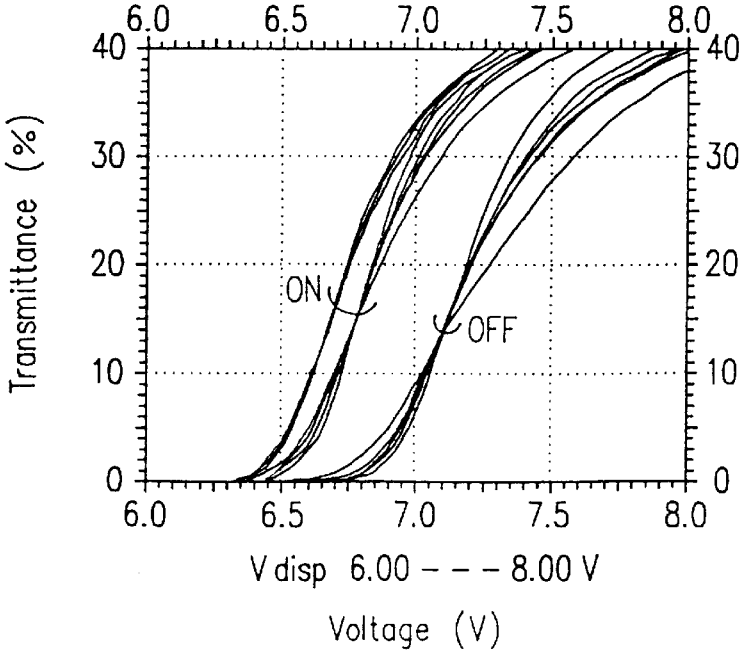
FIG. 25I is a graph showing transmittance in the respective cases shown in FIGS. 25A through 25H.

For comparison, FIGS. 25A through 25I show characteristics in a case where the same liquid crystal display panel as the above is driven by the SAT. FIGS. 25A through 25H are diagrams respectively showing driving waveforms with respect to display patterns A through H; FIG. 25I is a graph showing transmittance characteristics in the respective cases shown in FIGS. 25A through 25H. FIGS. 25A through 251 correspond to FIGS. 23A through 23I or FIGS. 24A through 24I.

In a case where a bias voltage is dispersed, a contrast is likely to increase as a whole using any driving method, unlike the above-mentioned case where a bias voltage is concentrated. However, according to the driving methods of the present invention shown in FIGS. 23A through 23H and 24A through 24H, the decrease in contrast is eliminated, unlike the SAT shown in FIGS. 25A through 25H. As is understood from the comparison between the characteristics in FIGS. 23I and 24I of the driving method of the present example and the characteristic in FIG. 25I of the SAT, the variation of transmittance caused by display pattern is less and display inconsistencies are less in the driving method of the present example.

Figure 26A:
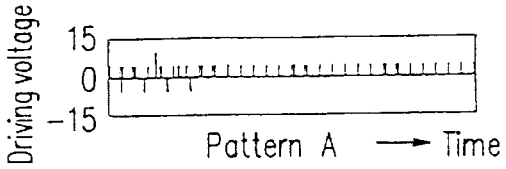
FIGS. 26A through 26H respectively show driving waveforms with respect to display patterns A through H in a case where the number of scanning electrodes L contained in one block is 60, under the condition that a bias voltage is uniformly dispersed in one frame period in Example 4 according to the present invention.
Figure 26B:
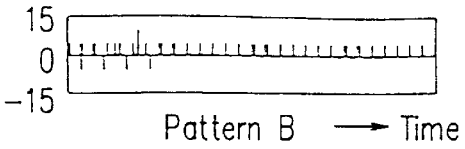
Figure 26C:
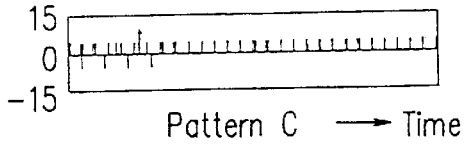
Figure 26D:
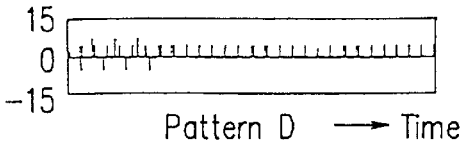
Figure 26E:
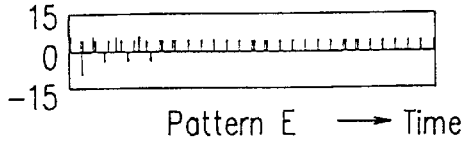
Figure 26F:
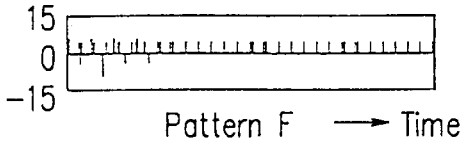
Figure 26G:
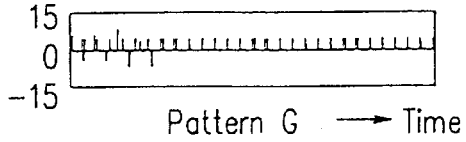
Figure 26H:
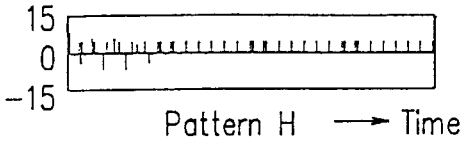
Figure 26I:
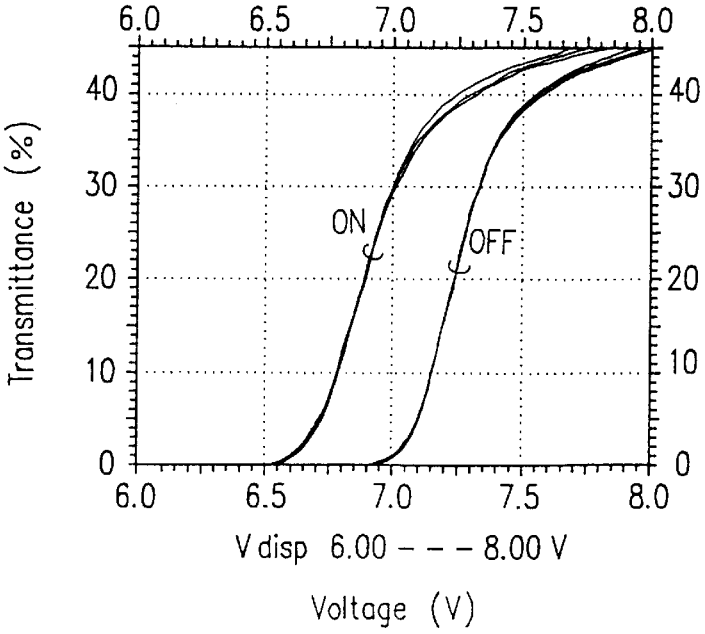
FIG. 26I is a graph showing transmittance characteristics in the respective cases shown in FIGS. 26A through 26H.
Figure 27A:
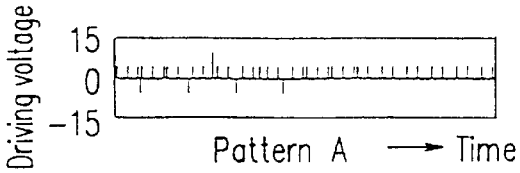
FIGS. 27A through 27H respectively show driving waveforms with respect to display patterns A through H in a case where the number of scanning electrodes L contained in one block is 120, under the condition that a bias voltage is uniformly dispersed in one frame period in Example 4 according to the present invention.
Figure 27B:
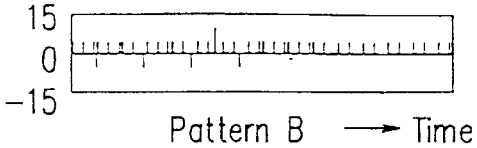
Figure 27C:
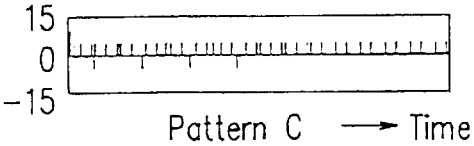
Figure 27D:
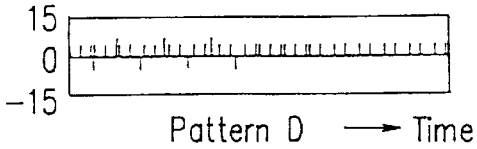
Figure 27E:
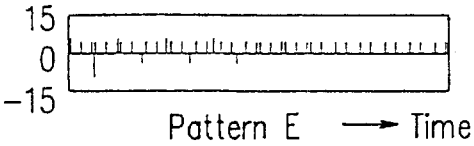
Figure 27F:
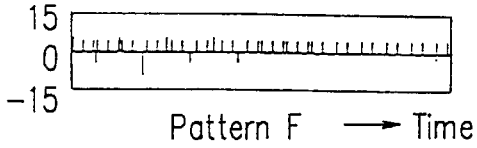
Figure 27G:
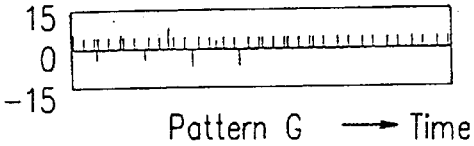
Figure 27H:
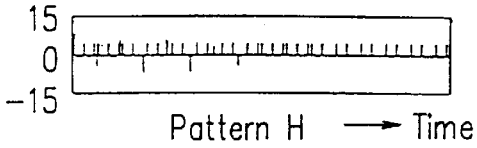
Figure 27I:
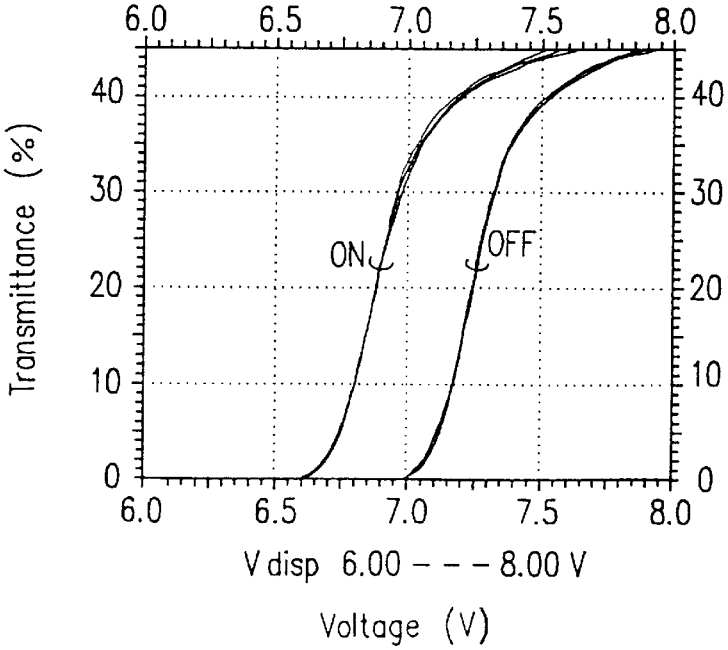
FIG. 27I is a graph showing transmittance characteristics in the respective cases shown in FIGS. 27A through 27H.

A driving waveform of an ON display in a case where a bias voltage is uniformly dispersed over one frame period will be described. FIGS. 26A through 26H are diagrams respectively showing driving waveforms with respect to display patterns A through H in a case where the number L of scanning electrodes included in one block is 60; FIG. 26I is a graph showing a transmittance characteristic in the respective cases shown in FIGS. 26A through 26H. Similarly, FIGS. 27A through 27H are diagrams respectively showing driving waveforms with respect to display patterns A through H in a case where the number L of scanning electrodes included in one block is 120; FIG. 27I is a graph showing a transmittance characteristic in the respective cases shown in FIGS. 27A through 27H. The display patterns A through H shown in FIGS. 26A through 26H and those shown in FIGS. 27A through 27H correspond to the display patterns of the respective columns A through H shown in FIG. 19.

Figure 28A:
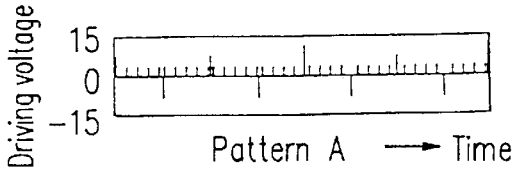
FIGS. 28A through 28H respectively show driving waveforms with respect to display patterns A through H in a case where an LCD panel of Example 4 according to the present invention is driven by the SAT while a bias voltage is uniformly dispersed in one frame period.
Figure 28B:
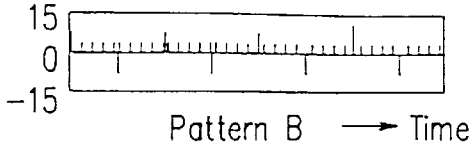
Figure 28C:
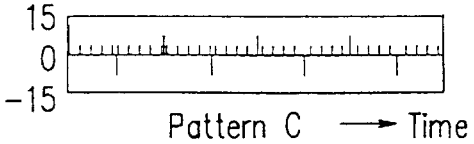
Figure 28D:
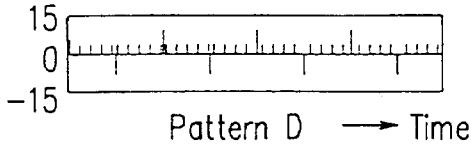
Figure 28E:
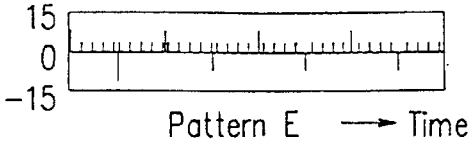
Figure 28F:
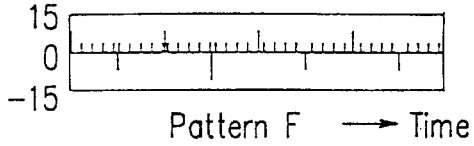
Figure 28G:
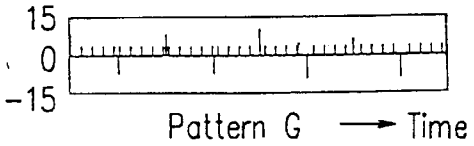
Figure 28H:
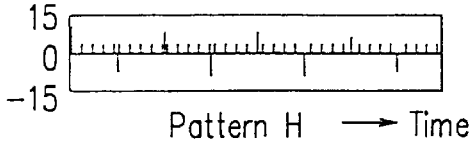
Figure 28I:
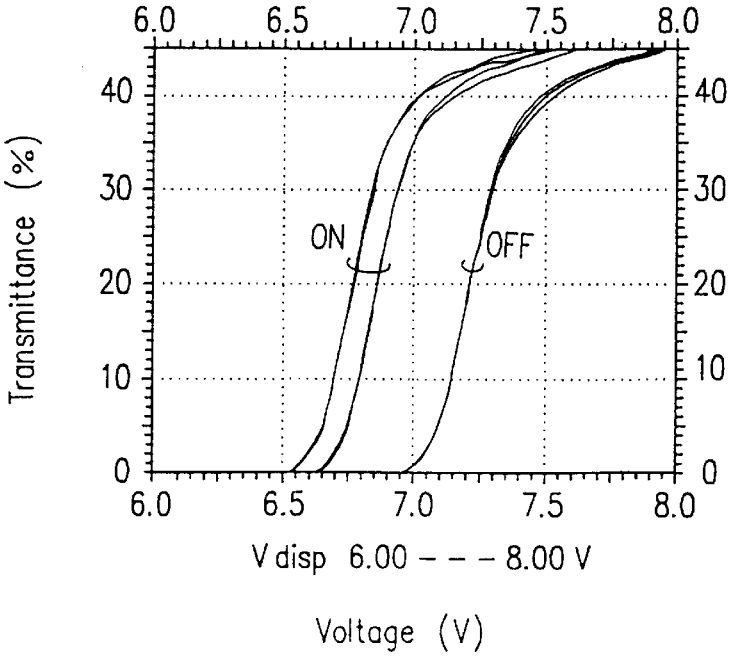
FIG. 28I is a graph showing transmittance characteristics in the respective cases shown in FIGS. 28A through 28H.

For comparison, FIGS. 28A through 28I show characteristics in a case where the same liquid crystal display panel as the above is driven by the SAT. FIGS. 28A through 28H are diagrams respectively showing driving waveforms with respect to display patterns A through H; FIG. 28I is a graph showing transmittance characteristics in the respective cases shown in FIGS. 28A through 28H. FIGS. 28A through 281 correspond to FIGS. 26A through 26I or FIGS. 27A through 27I.

In the above-mentioned case, a contrast is likely to increase to a great degree even according to the SAT shown in FIGS. 28A through 28H. However, actually, a display characteristic in the case of adopting the SAT is greatly varied depending upon display data. In other words, a bias state to be applied is greatly varied in accordance with display patterns from a state where a bias voltage is concentrated to a state where a bias voltage is uniformly dispersed. Because of this, the synergistic influence of the variation of transmittance depending upon display patterns caused by an orthogonal function and the change in transmittance caused by a frame response phenomenon leads to large display inconsistencies in some cases.

According to the driving method of the present example, even in a case of displaying a display pattern in which a bias voltage is concentrated, a bias voltage is dispersed in one frame, so that the variation of transmittance caused by the frame response phenomenon is eliminated. Furthermore, the period required for an orthogonal property to be established is shorter than that of the SAT on the basis of the driving principle of the present example; therefore, display inconsistencies depending upon display patterns caused by an orthogonal property of a function can also be eliminated.

Example 5

In the present example, an STN liquid crystal display element having a response time $\tau$ of 100 ms and the number N of row scanning electrodes of 380 is driven in the bias state described with reference to Example 4 under the conditions that the number L of scanning electrodes included in one block is 60, the number K of simultaneously selected scanning electrodes is 7, a frame frequency F is 60 Hz, and a proportional constant A is ⅛, and optical characteristics of the display thus obtained are measured.

As a result, in the similar manner to Example 4 (N=240), the variation of transmittance is hardly observed depending upon display patterns.

When the STN liquid crystal display element is driven by the SAT under the condition that the number K of simultaneously selected scanning electrodes is 7, transmittance is varied depending upon display patterns by about 10% during an ON display period and by about 3% during an OFF display period.

Example 6

In the above-mentioned examples, binary displays have been described. In the present example, the case where a gray scale display is performed by varying a pulse width of a data signal will be described.

Figures 29A, 29B:
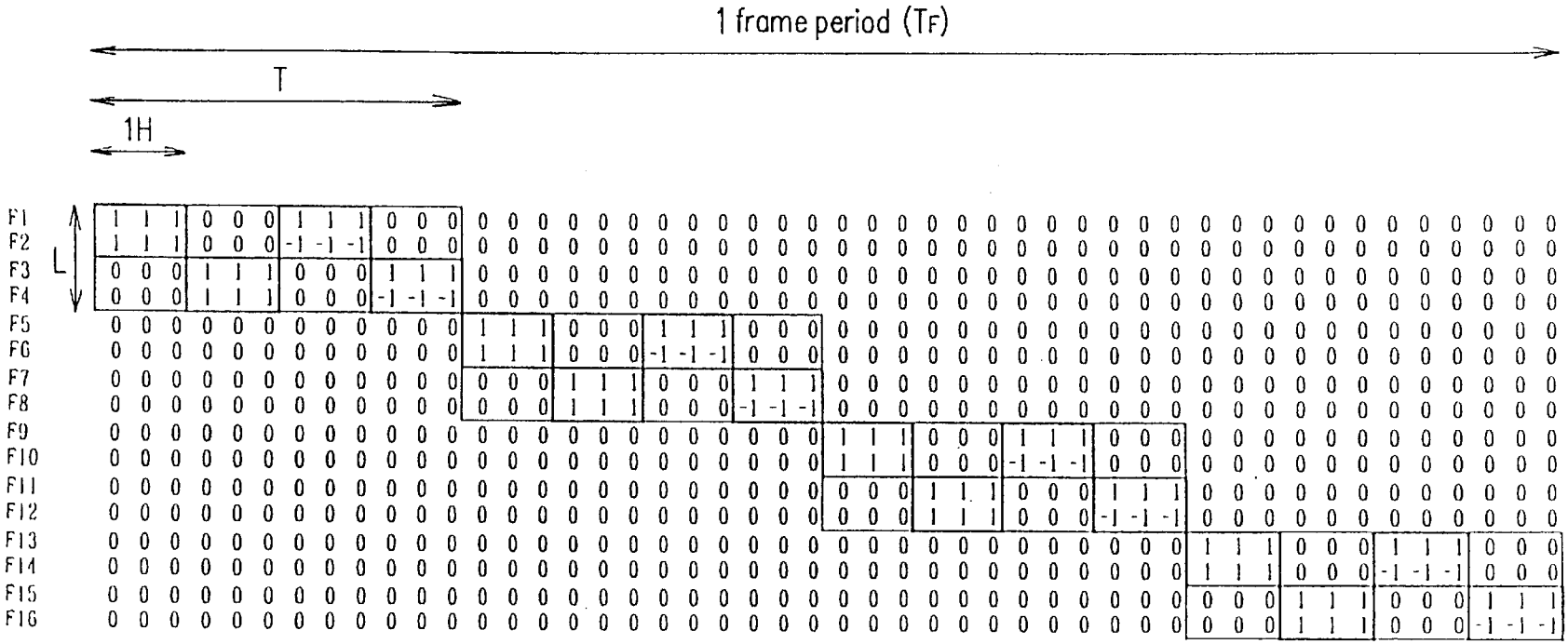
FIGS. 29A and 29B show a function used for orthogonally transforming display data used in a case where a 4-level gray scale display is performed in Example 6 according to the present invention.

FIGS. 29A and 29B show a function used for orthogonal transformation of display data utilized for performing a 4-level gray scale display in the present example. In the present example, as shown in FIG. 29A, a pulse width during a predetermined period 1H (referred to as "one horizontal period") corresponding to ¼ of a division period T is divided into three parts. Display data of 4 scaling levels is represented by the combination of 1 and −1 as shown in FIG. 29B. For example, scaling level 1 is represented by the combination of "−1, −1, −1". It is noted that the combination shown in FIG. 29B is merely an example, to which the combination is not limited.

An arithmetic operation is performed between an orthogonal function in FIG. 29A and display data at a timing corresponding to ⅓ of one horizontal period, and the operation result thus obtained is sent to a data-side driver. The data input to the driver is sent to the data electrode driving circuit per ⅓ scanning period so as to output a data signal voltage in unison.

Figure 30A:
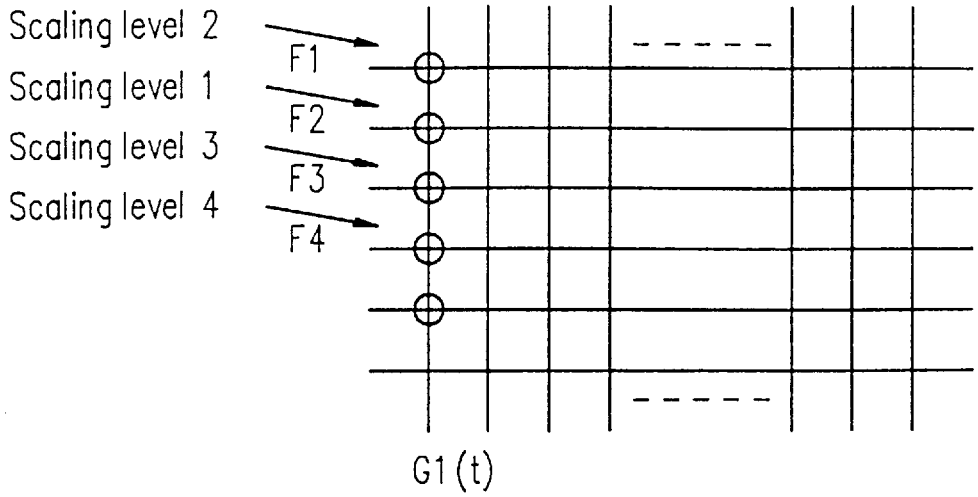
FIGS. 30A and 30B show an exemplary display data in a case of using the orthogonal transforming function shown in FIGS. 29A and 29B in Example 6 according to the present invention.
Figure 30B:
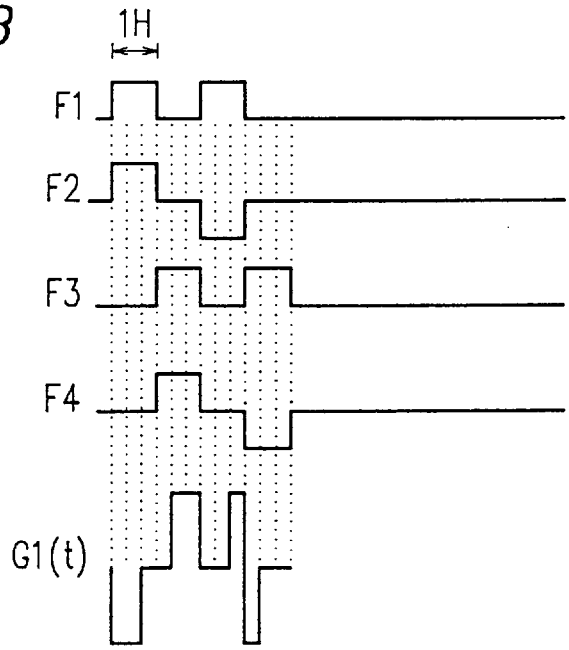

FIG. 30A shows an exemplary application of display data for performing a gray scale display of the present example. More specifically, display data of scaling level 2, scaling level 1, scaling level 3, and scaling level 4 are successively applied to the first to fourth scanning electrodes F1 to F4. FIG. 30B shows exemplary waveforms of scanning signal voltages in a case where a gray scale display is performed as shown in FIG. 30A. More specifically, the first to fourth scanning electrodes F1 to F4 shown in FIG. 30B represent voltage waveforms to be applied to the scanning electrodes in the first to fourth rows, which are derived from the function data shown in FIG. 29A. G1(t) of FIG. 30B shows a data signal voltage, which is obtained by substituting the function data of FIG. 29A and the data of FIG. 29B into the following equation (15) per H/3.

$$G1(t) = A \cdot \sum_{i=1}^{N} (Fi(t) \cdot Iij) \tag{15}$$

As is understood from these figures, one frame's worth of data processing and voltage application are conducted in accordance with the driving method of the present example, whereby a satisfactory display corresponding to the input gray scale display pattern is reproduced on the liquid crystal display panel.

Example 7

In the present example, a gray scale level between an ON display and an OFF display is displayed by varying the ratio between the number of frames for performing an ON display and the number of frames for performing an OFF display, considering a plurality of frames as one group.

FIGS. 31A and 31B show a function used for orthogonal transformation of display data utilized for performing a 4-level gray scale display in the present example. In the present example, considering three frames (that is, $T_F \times 3$) as one group, display data of 4 scaling levels are represented by the combination of 1 and −1 as shown in FIG. 31B. For example, scaling level 1 is represented by the combination of "−1, −1, −1" spreading across three frames. It is noted that the combination shown in FIG. 31B is merely an example, to which the combination is not limited.

Figure 32A:
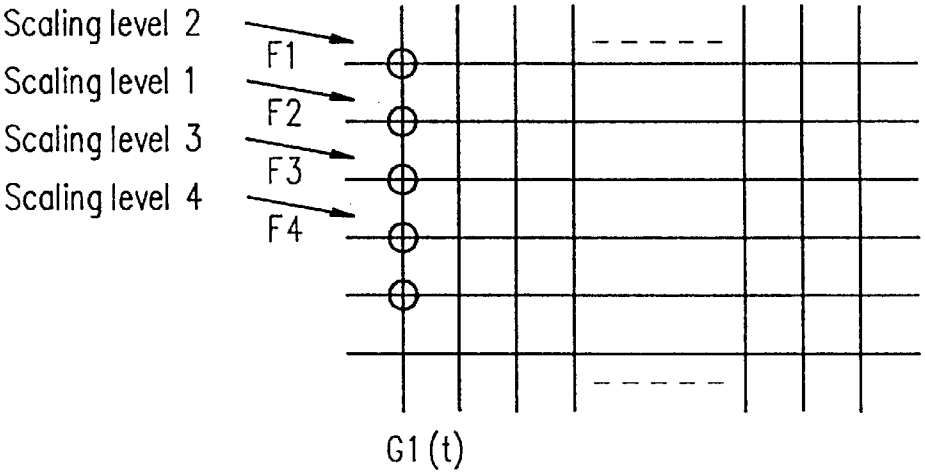
FIG. 32A shows gray scaling levels.
Figure 32B:
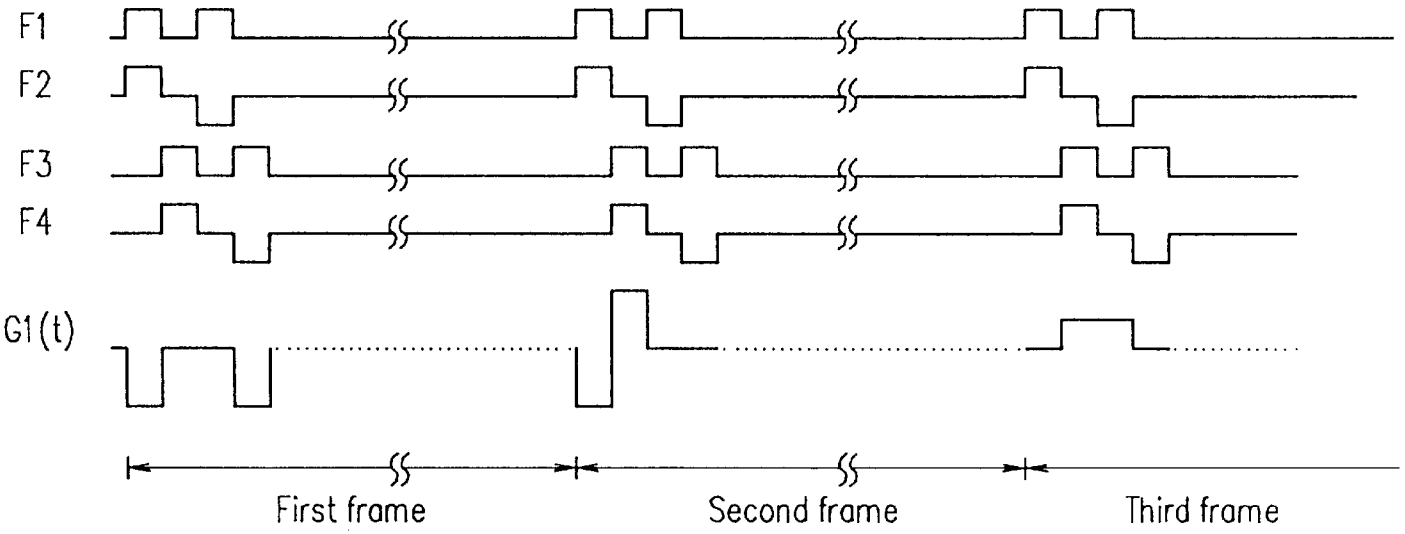
FIG. 32B shows exemplary driving waveforms in a case where the gray scaling levels shown in FIG. 32A are displayed.

FIGS. 31A and 31B show a function used for orthogonal transformation of a data pattern in a 4-level gray scale display of the present example. FIG. 32B shows exemplary driving waveforms in a case where scaling levels as shown in FIG. 32A are displayed. G1(t) of FIG. 32B shows a data signal voltage.

FIG. 32A shows an exemplary application of display data for performing a gray scale display of the present example. More specifically, display data of scaling level 2, scaling level 1, scaling level 3, and scaling level 4 are successively applied to the first to fourth scanning electrodes F1 to F4. FIG. 32B shows exemplary waveforms of scanning signal voltages in a case where a gray scale display is performed as shown in FIG. 32A. More specifically, the first to fourth scanning electrodes F1 to F4 shown in FIG. 32B represent voltage waveforms to be applied to the scanning electrodes in the first to fourth rows, which are derived from the function data shown in FIG. 31A. G1(t) of FIG. 32B shows a data signal voltage, which is obtained by substituting the function data of FIG. 31A and the data of FIG. 31B into the following equation (15):

$$G1(t) = A \cdot \sum_{i=1}^{N} (Fi(t) \cdot Iij) \tag{15}$$

As is understood from these figures, according to the driving method of the present example, a satisfactory display of 4-level gray scale can be realized by varying the ratio between an ON and an OFF over 3 frame periods.

Example 8

A gray scale display is performed by combining a pulse width gray scale described in Example 6 and a frame gray scale described in Example 7.

In general, display flicker is caused in the frame gray scale with the increase in the number of gray scales. In the pulse width gray scale, display inconsistencies are caused by the increase in high frequency components with the increase in the number of gray scales. However, when a multi-level gray scale display is performed by appropriately combining the pulse gray scale and the frame gray scale as in the present example, deficiencies in both of the pulse gray scale and the frame gray scale can be compensated with each other, whereby a satisfactory gray scale display characteristic eliminating the display flicker and the display inconsistencies can be realized.

When STN liquid crystal display devices are driven in accordance with the driving method of the present example, display inconsistencies can be eliminated, which are caused depending upon orthogonal conditions in the AAM and the SAT. Thus, a more satisfactory gray scale display characteristic can be realized according to the driving method of the present example, compared with the AAM and the SAT.

Example 9

The present example shows a driving method in which display inconsistencies caused by the overlapping, onto a scanning signal voltage of a voltage waveform distorted in a spike shape which are induced onto scanning electrodes through capacitance of a liquid crystal layer.

An LCD is composed of a series RC circuit including a capacitance of a liquid crystal layer, a wiring resistance of scanning electrodes and data electrodes, and an output resistance of a scanning electrode driving circuit and a data electrode driving circuit. Thus, the LCD can be considered as a differentiating circuit allowing only the changed components of a voltage to pass therethrough.

Figure 33:
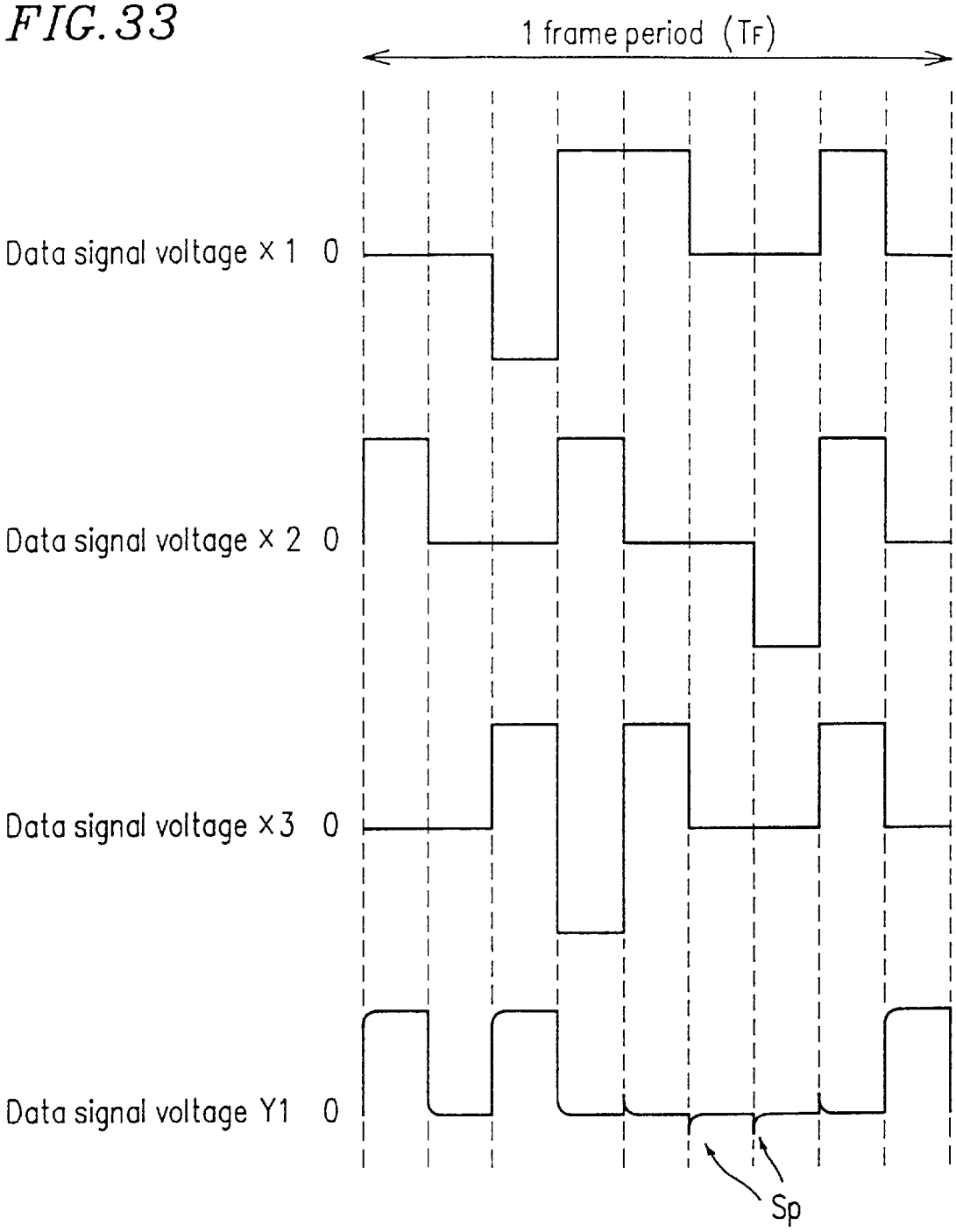
FIG. 33 is a diagram schematically showing voltages distorted in a spike shape which are induced onto scanning electrodes in a case where a driving voltage is a square wave.

Because of the above, as shown in FIG. 33, when a data signal voltage applied to data electrodes is changed, a voltage waveform Sp distorted in a spike shape which is differentiated via capacitance of the liquid crystal layer is induced onto scanning electrodes so as to be overlapped onto a scanning signal voltage Y1. Such a voltage waveform Sp causes the difference in rms voltage value applied to pixels, leading to the generation of display inconsistencies.

Figure 34:
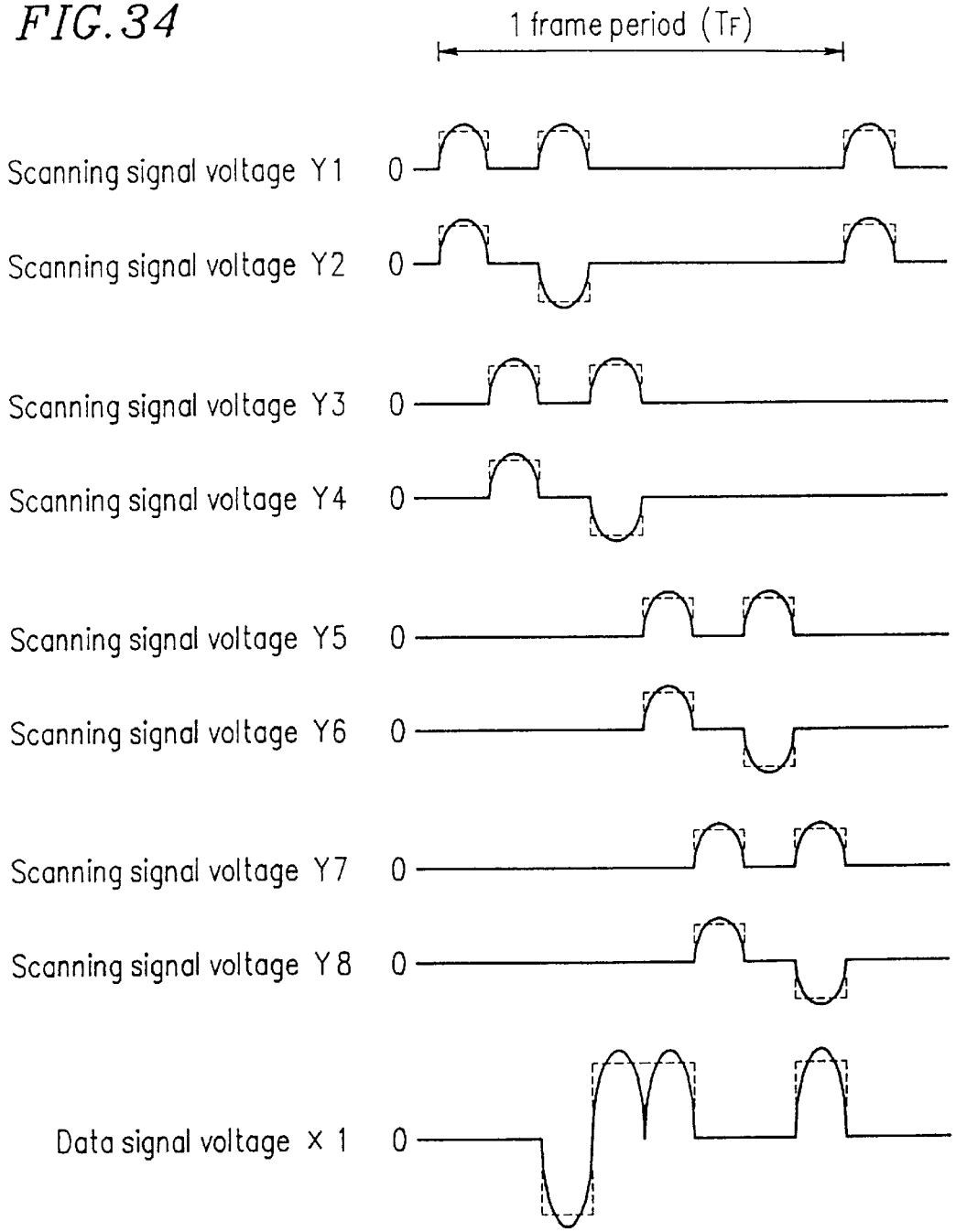
FIG. 34 is a diagram showing waveforms of scanning signal voltages and a data signal voltage in Example 9 according to the present invention.

In order to eliminate the above-mentioned inconveniences, in the present example, at least one of a scanning signal voltage, which the scanning electrode driving circuit applies to the scanning electrodes, and a data signal voltage, which a data electrode driving circuit applies to each data electrode, is controlled so as to have a voltage waveform as shown in FIG. 34. More specifically, every time an application period of a selection pulse starts, a scanning signal voltage or a data signal voltage is once monotonously increased and then monotonously decreased so as to obtain a convex voltage waveform. Alternatively, every time an application period of a selection pulse starts, a scanning signal voltage or a data signal voltage is once monotonously decreased and then monotonously increased so as to obtain a concave voltage waveform. In this way, the generation of distorted voltages can be prevented. Furthermore, only distorted voltages are detected by detecting electrodes as described later, and voltage components compensating the distorted voltages are applied to scanning signal voltages, whereby display inconsistencies are eliminated.

Figure 35:
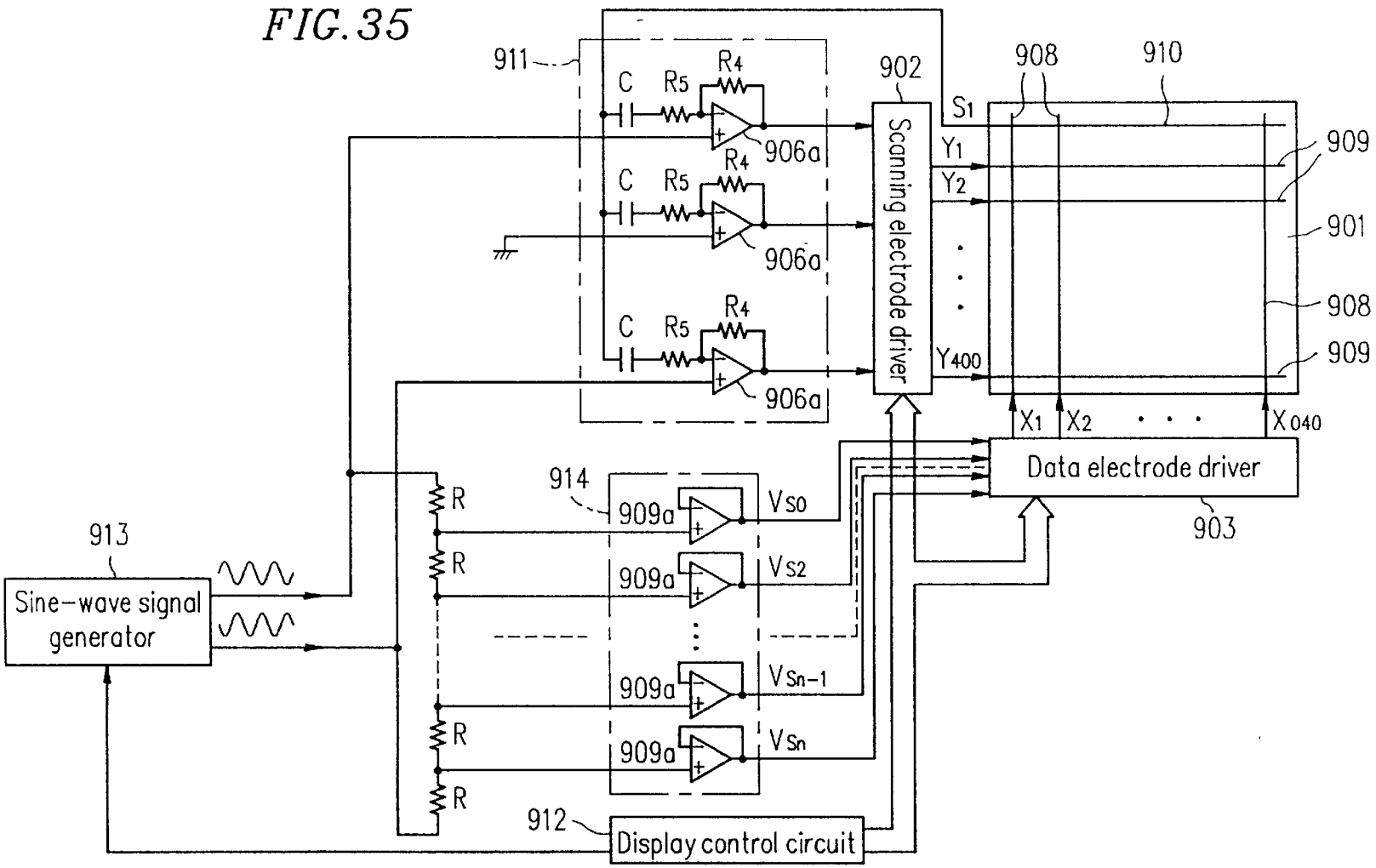
FIG. 35 is a diagram showing an exemplary configuration of an LCD equipped with a driving circuit of Example 9 according to the present invention.

FIG. 35 is a diagram showing an exemplary configuration of an LCD equipped with a driving circuit of the present example. A liquid crystal display panel 901 is provided with a plurality of scanning electrodes 909 and a plurality of data electrodes 908 disposed so as to cross the scanning electrodes 909. A detection electrode 910 for detecting distortion of voltages is provided so as to be in parallel with the scanning electrodes 909. The scanning electrodes 909 are respectively connected to a scanning electrode driving circuit (scanning electrode driver) 902 and the data electrodes 908 are respectively connected to a data electrode driving circuit (data electrode driver) 903. Furthermore, the detection electrode 910 is connected to a distortion correcting circuit 911.

An output signal from a display control circuit 912 is input to the scanning electrode driver 902 and the data electrode driver 903. The display control circuit 912 includes a buffer memory, an orthogonal function generator, an EX-OR circuit, and various kinds of timing signal generators, and output a predetermined signal to the scanning electrode driver 902, the data electrode driver 903, etc. Upon receiving an output signal from the display control circuit 912, a sine-wave signal generator 913 generates two kinds of voltages based on a sine-wave signal.

The distortion correcting circuit 911 provided on the output side of the sine-wave signal generator 913 includes capacitors C, resistors R4 and R5, and amplifiers 906*a*. A signal passing through a series circuit of the capacitor C and the resistor R5 and a signal fed back from an output terminal of the amplifier 906*a* through the resistor R4 are respectively input to minus (−) terminal of the amplifier 906*a*. Furthermore, a signal detected by the detection electrode 910 for detecting distortion of voltages, i.e., the voltage waveform Sp distorted in a spike shape is input to the capacitor C.

On the other hand, a plus (+) terminal of the amplifier 906*a* is connected to an output terminal of the sine-wave signal generator 913 or grounded. In this circuit configuration, based on two kinds of voltages output from the sine-wave signal generator 913, a voltage of 0 volt (ground voltage) and the voltage waveform Sp distorted in a spike shape detected by the detection electrode 910, the distortion correcting circuit 911 generates a signal containing, as its part, a signal with a reverse potential for compensating the distorted voltage. The generated output signal is output to the scanning electrode driver 902.

The scanning electrode driver 902 outputs a voltage waveform to each scanning electrode 909 based on a signal from the distortion correcting circuit 911 and orthogonal function data from the display control circuit 912. A multi-valued voltage obtained by dividing two kinds of voltage waveforms generated by the sine-wave signal generator 913 with resistances is supplied to the data electrode driver 903 through a buffer circuit 914. The data electrode driver 903 outputs a data signal voltage to each data electrode 908 in the liquid crystal display panel 901 in accordance with operation data orthogonally transformed in the display control circuit 912. Thus, the liquid crystal display panel 901 is supplied with a difference voltage between the scanning voltage and the data voltage, and one frame's worth of data transformation processing and data voltage application are completed. Accordingly, a display pattern is reproduced on the liquid crystal display panel 901.

The scanning signal voltage and the data signal voltage in the LCD having the configuration as shown in FIG. 35 have waveforms as shown in FIG. 34. The waveforms shown in FIG. 34 are obtained in a case where the number N of scanning electrodes is 8, the size L of each block is 4, and the number L of simultaneously selected electrodes is 2.

As is understood from FIG. 34, the waveform of each scanning signal voltage is transformed so that a voltage waveform according to an orthogonal function changes in a concave and convex shape per application period of a selection pulse. The distortion correcting circuit 911 performs a distortion correction so as to compensate a distorted voltage induced onto the detection electrode 910, so that distorted voltage waveforms do not appear.

As described above, when the voltage waveforms of the scanning signal voltage and the data signal voltage which are respectively applied to the scanning electrodes and the data electrodes mildly change in a concave and convex shape, the change in distorted voltage of a differential waveform caused on counter electrodes via capacitance of pixels become smaller, compared with the case where the voltage waveforms rapidly change in a square pulse shape as in the conventional example. In this way, steep distortion of waveforms are not caused; therefore, distortion correction can be conducted without fail even if a circuit element with a relatively slow response speed is used for the distortion correcting circuit.

In the present example, the scanning voltage waveform and the data voltage waveform are transformed so as to become sine waves. However, the concave and convex shape of the voltage waveform used in the present invention is not limited to the sine waves. For example, in a case where a convex voltage waveform is obtained, any voltage waveforms can be used, as long as, during an application period of a selection pulse, a voltage monotonously increases with time without temporarily decreasing to reach the maximum value and thereafter monotonously decreases with time without temporarily increasing. More specifically, voltage waveforms such as a half cycle of a sine wave, a semi-circle, a semi-polygon, and a triangle can be used. It is desired that the voltage waveform has a small change rate of voltage. However, the present invention is not limited thereto.

In the above description, liquid crystal display panels including liquid crystal as a display medium between a pair of substrates are exemplified. However, the present invention is not limited thereto, and can also be applied to display panels using other materials as a display medium.

According to the driving methods described in Examples 2 to 9, a period required for an orthogonal property to be established corresponds to the division period T. Thus, the time required for an orthogonal property to be established is shorter than that of the AAM and the SAT in which one frame period is required for an orthogonal property between the respective scanning electrodes to be established. Because of this, according to the present invention, even when an image is displayed at an ordinary frame frequency (i.e., about 60 Hz) in a fast-response display panel, a frame response phenomenon involved in the prior art can be eliminated. Furthermore, according to the present invention, display inconsistencies caused in the AAM and the SAT can be eliminated. As a result, a uniform display characteristic with a high contrast can be realized. Furthermore, since the display inconsistencies can be eliminated, the present invention is very advantageous in performing a gray scale display.

The SAT and the AAM requires one frame's worth of buffer memory based on their driving principles, whereas the driving method of the present invention can be realized with a buffer memory having a capacity of ½ or less of that of the SAT and the AAM since the number of scanning electrodes to be subject to operation is small. Because of this, the present invention is very advantageous in terms of a circuit size and a cost. In addition, the AAM requires a circuit size large enough for performing an operation of the entire scanning electrodes, whereas the present invention merely requires a circuit size large enough for performing an operation of selected scanning electrodes. Thus, the driving method of the present invention is very advantageous in terms of a circuit size.

Furthermore, according to the driving method of the present invention, the selection pulse is dispersed at a plurality of timings so as to be applied to the scanning electrodes during one frame period T. Because of this, compared with the IHAT, the circuit configuration (e.g., an operation circuit, an orthogonal function generating circuit) can be substantially simplified and power consumption can be reduced.

The number of voltage levels on the side of the data electrode driver increases in proportion to the number of simultaneously selected scanning electrodes, so that an expensive analog driver is required for implementing the IHAT and the AAM. In contrast to this, the driving method of the present invention can be implemented with a inexpensive multi-level driver, since the number of simultaneously selected scanning electrodes is small.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display device comprising:

a simple matrix liquid crystal display panel having N scanning electrodes disposed in parallel with each other and M data electrodes disposed in parallel with each other so as to cross the scanning electrodes, pixels being respectively provided at crossed points of the scanning electrodes and the data electrodes;

a memory for storing image data corresponding to each of N/L scanning electrode groups, a majority of the groups including L scanning electrodes, L being smaller than N;

orthogonal function generating means for generating orthogonal function data for each scanning electrode group;

first operation means for multiplying image data corresponding to each of the scanning electrode groups output from the memory by the orthogonal function data output from the orthogonal function generating means and outputting resultant product data;

second operation means for successively receiving and adding up the product data and outputting resultant sum data;

third operation means for multiplying the sum data by a predetermined proportional constant A so as to generate a driving control signal and outputting the generated driving control signal;

data electrode driving means for outputting a data electrode driving signal based on the output driving control signal; and scanning electrode driving means for receiving the orthogonal function data from the orthogonal function generating means and scanning the scanning electrode groups in synchronization with the output of the data electrode driving signal, wherein the predetermined proportional constant A is set in a range of $(1/\sqrt{N})<A\leqq(1\sqrt{N})\cdot 4$.

2. A liquid crystal display device according to claim 1, wherein the number L of the scanning electrodes in each of the scanning electrode groups is selected so as to be close to N/2.

3. A liquid crystal display device according to claim 1, wherein the scanning electrode driving means outputs an electric potential of ±Vr volts to selected scanning electrodes and an electric potential of 0 volt to non-selected scanning electrodes.

4. A liquid crystal display device according to claim 1, wherein the first operation means is an exclusive OR circuit, and the second operation means is a sum circuit.

5. The liquid crystal device of claim 1, wherein $N\geqq 5$.

6. A method for driving a liquid crystal display device including a simple matrix liquid crystal display panel having N scanning electrodes disposed in parallel with each other and M data electrodes disposed in parallel with each other so as to cross the scanning electrodes, comprising the steps of:

dividing the scanning electrodes into N/L groups, L being a predetermined number, and successively driving each group utilizing an orthogonal function;

applying an electric potential of ±Vr volts to selected scanning electrodes and an electric potential of 0 volt to non-selected scanning electrodes, respectively as a scanning electrode driving signal;

applying an electric potential, obtained by multiplying a sum of products of an image display pattern and the scanning electrode driving signal by a predetermined proportional constant A, to the data electrode as a data electrode driving signal, wherein the proportional constant A is set in a range of $(1/\sqrt{N})<A\leqq(1\sqrt{N})\cdot 4$.

7. A method for driving a liquid crystal display device according to claim 6, wherein the predetermined number L is selected so as to be close to N/2.

8. A method for driving a liquid crystal display device according to claim 6, wherein an exclusive OR operation and a sum operation are performed for obtaining the sum of products.

9. The method of claim 6, wherein N≧5.

10. A method for driving a liquid crystal display device including a simple matrix liquid crystal display panel having N scanning electrodes disposed in parallel with each other and M data electrodes disposed in parallel with each other so as to cross the scanning electrodes, the N scanning electrodes being grouped into N/L scanning electrode groups, a majority of the groups including L scanning electrodes, L being smaller than N, the method comprising the steps of:

(a) storing image data corresponding to selected one of the N/L scanning electrode groups in a memory;

(b) generating orthogonal function data of L bits;

(c) reading the image data from the memory;

(d) multiplying the orthogonal function data by the image data on a pixel by pixel basis to obtain product data and summing the product data with respect to all of the pixels to generate sum data;

(e) multiplying the sum data by a predetermined proportional constant A to generate a driving control signal;

(f) outputting a data electrode driving signal to either one of the data electrodes based on the driving control signal;

(g) repeating the steps (b) through (f) with respect to each of the L data electrodes included in the selected scanning electrode group;

(h) simultaneously driving the L scanning electrodes included in the selected scanning electrode group and a data electrode group composed of the data electrodes associated with the selected scanning electrode group;

(i) generating another orthogonal function data of L bits and repeating the steps (b) through (h) with respect to all of the orthogonal function data of L bits; and (j) repeating the steps (a) through (i) for each of the remaining scanning electrode groups so as to scan the liquid crystal display panel, wherein the proportional constant A is set in a range of $(1/\sqrt{N})<A\leqq(1\sqrt{N})\cdot 4$.

11. A method for driving a liquid crystal display device according to claim 10, wherein the number L of the scanning electrodes in each of the scanning electrode group is selected so as to be close to N/2.

12. A method for driving a liquid crystal display device according to claim 10, wherein the scanning electrode driving means outputs an electric potential of ±Vr volts to selected scanning electrodes and an electric potential of 0 volt to non-selected scanning electrodes.

13. A method for driving a liquid crystal display device according to claim 10, wherein an exclusive OR operation is performed for obtaining the product data and an adding operation is performed for obtaining the sum data.

14. The method of claim 10, wherein N≧5.

15. A method for driving a liquid crystal display device including a simple matrix liquid crystal display panel having a plurality of scanning electrodes and a plurality of data electrodes disposed so as to cross the scanning electrodes, pixels being respectively provided at crossed points of the scanning electrodes and the data electrodes, the method comprising the steps of:

(a) dividing the plurality of scanning electrodes into a plurality of blocks composed of a first number of scanning electrodes, the first number being smaller than a total number of the scanning electrodes, and further dividing each of the plurality of blocks into a plurality of groups composed of a second number of a plurality of scanning electrodes, the second number being smaller than the first number;

(b) simultaneously applying a selection pulse string according to an orthogonal function, as a scanning electrode driving signal in a predetermined period, to the scanning electrodes included in one of the plurality of groups and included in a selected one of the blocks and applying a voltage at a predetermined level to the scanning electrodes included in the other groups of the selected block, one frame period corresponding to a period for displaying one display screen and including a plurality of division periods, each division period including a plurality of predetermined periods; and (c) applying a data electrode driving signal corresponding to a sum of products of the orthogonal function and display data to each of the data electrodes associated with the selected block, wherein the steps (b) and (c) are performed with respect to all of the plurality of blocks in the one frame period with timing shifted.

16. A method for driving a liquid crystal display device according to claim 15, wherein the number of the scanning electrodes is N, the number of the data electrodes is M, a scanning electrode driving signal applied to an i-th row ($1\leqq i\leqq N$) of the scanning electrodes is given by a predetermined function Fi(t), and a data electrode driving signal applied to a j-th column ($1\leqq j\leqq M$) of the data electrodes is given by $$Gj(t) = A \cdot \sum_{i=1}^{N} (Fi(t) \cdot Iij) \tag{14}$$

where a proportional constant A is $1/\sqrt{N}<A\leqq(1/\sqrt{N})\cdot 4$.

17. A method for driving a liquid crystal display device according to claim 15, further comprising the step of performing frame modulation for varying a ratio between ON data and OFF data in the data electrode driving signal in accordance with the display data over a plurality of frames, thereby performing a gray scale display.

18. A method for driving a liquid crystal display device according to claim 15, further comprising the step of performing pulse modulation for varying a pulse width of the data electrode driving signal in accordance with the display data, thereby performing a gray scale display.

19. A method for driving a liquid crystal display device according to claim 15, further comprising the step of performing a combination of frame modulation for varying a ratio between ON data and OFF data in the data electrode driving signal in accordance with the display data over a plurality of frames and pulse modulation for varying a pulse width of the data electrode driving signal in accordance with the display data, thereby performing a gray scale display.

20. A method for driving a liquid crystal display device according to claim 15, further comprising the step of monotonously increasing at least one of the scanning electrode driving signal and the data electrode driving signal, followed by monotonously decreasing it, or monotonously decreasing at least one of the scanning electrode driving signal and the data electrode driving signal, followed by monotonously decreasing it, every time an application period of a selection pulse starts, thereby forming a voltage waveform with a predetermined rms.

21. A method for driving a liquid crystal display device according to claim 15, further comprising the steps of detecting a distorted electric potential generated on a detection electrode provided in parallel with the scanning electrodes and applying a voltage component compensating the distorted electric potential to the scanning electrode driving signal.

22. A liquid crystal display device comprising:

a simple matrix liquid crystal display panel including a plurality of scanning electrodes and a plurality of data electrodes disposed so as to cross the scanning electrodes, pixels being respectively provided at crossed points of the scanning electrodes and the data electrodes; and driving means for dividing the plurality of scanning electrodes into a plurality of blocks composed of a first number of scanning electrodes, the first number being smaller than a total number of the scanning electrodes, and further dividing each of the plurality of blocks into a plurality of groups composed of a second number of a plurality of scanning electrodes, the second number being smaller than the first number, the driving means further performing a first operation for simultaneously applying a selection pulse string according to an orthogonal function, as a scanning electrode driving signal in a predetermined period, to the scanning electrodes included in one of the plurality of groups and included in a selected one of the blocks and for applying a voltage at a predetermined level to the scanning electrodes included in the other groups of the selected block, and a second operation for applying a data electrode driving signal corresponding to a sum of products of the orthogonal function and display data to each of the data electrodes associated with the selected block, one frame period corresponding to a period for displaying one display screen and including a plurality of division periods, each division period including a plurality of predetermined periods, wherein the first and second operations are performed with respect to all of the plurality of blocks in the one frame period with timing shifted.

* * * * *